US007779902B2

(12) United States Patent
Coyle, Jr.

(10) Patent No.: US 7,779,902 B2
(45) Date of Patent: Aug. 24, 2010

(54) ARM FOR MOVING FLEXIBLE LINES AT A WELLSITE

(75) Inventor: William E. Coyle, Jr., Houma, LA (US)

(73) Assignee: Bilco Tools, Inc., Houma, LA (US)

( * ) Notice: Subject to any disclaimer, the term of this patent is extended or adjusted under 35 U.S.C. 154(b) by 412 days.

(21) Appl. No.: 11/903,058

(22) Filed: Sep. 20, 2007

(65) Prior Publication Data

US 2008/0006400 A1 Jan. 10, 2008

Related U.S. Application Data

(63) Continuation-in-part of application No. 10/979,971, filed on Nov. 3, 2004, now Pat. No. 7,201,233, which is a continuation of application No. 10/982,861, filed on Sep. 24, 2004, now Pat. No. 7,610,965.

(51) Int. Cl.
*E21B 19/08* (2006.01)

(52) U.S. Cl. ..... 166/77.2; 166/77.1

(58) Field of Classification Search ..... 166/380, 166/384, 385, 77.1, 77.2, 85.5
See application file for complete search history.

(56) References Cited

U.S. PATENT DOCUMENTS 2,262,364 A * 11/1941 Hugel et al. ..... 166/77.1
4,274,778 A 6/1981 Putnam et al.
4,281,716 A 8/1981 Jall
5,503,234 A 4/1996 Clanton
5,823,258 A * 10/1998 Goldner ..... 166/77.1
6,131,664 A 10/2000 Sonnier
6,591,471 B1 7/2003 Hollingsworth et al.
6,742,596 B2 6/2004 Haugen
7,043,814 B2 5/2006 Hollingsworth et al.
7,073,598 B2 7/2006 Haugen
7,216,716 B2 * 5/2007 Cole et al. ..... 166/379
2004/0079533 A1 4/2004 Buytaert et al.
2005/0161227 A1 7/2005 Hayes et al.
2006/0027375 A1 2/2006 Thomas, Jr. et al.
2006/0065407 A1 3/2006 Rufey
2008/0264650 A1 * 10/2008 Begnaud et al. ..... 166/381

OTHER PUBLICATIONS

Weatherford AutoCLAMP System pp. 1.

* cited by examiner

*Primary Examiner*—Hoang Dang
(74) *Attorney, Agent, or Firm*—Browning Bushman P.C.

(57) ABSTRACT

A movable arm 10 engages a flexible line 50 at a well site for positioning the flexible line between run-in position for passing the flexible line with a tubular through a well hole in the rig floor and a clamping position wherein the flexible line is adjacent the tubular above the rig floor for clamping the line to the tubular. The arm 10 extends upward from the rig floor 70, and includes a line guide, such as roller 12, for engaging the flexible line when in the run-in position. A powered drive 14 moves the arm between the run-in position and the clamping position. A spacer 82 may be used for positioning two or more flexible lines at a desired spacing relative to one another prior to positioning the lines within a clamp secured to the tubular. A slip bowl assembly 60 may be laterally movable so that slips do not engage the flexible line as it is run in the well.

20 Claims, 22 Drawing Sheets

FIG 10
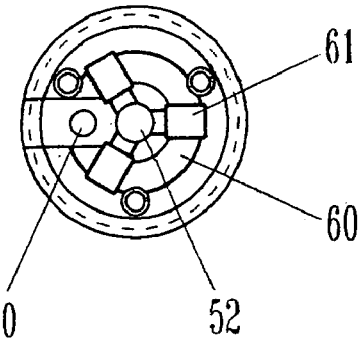
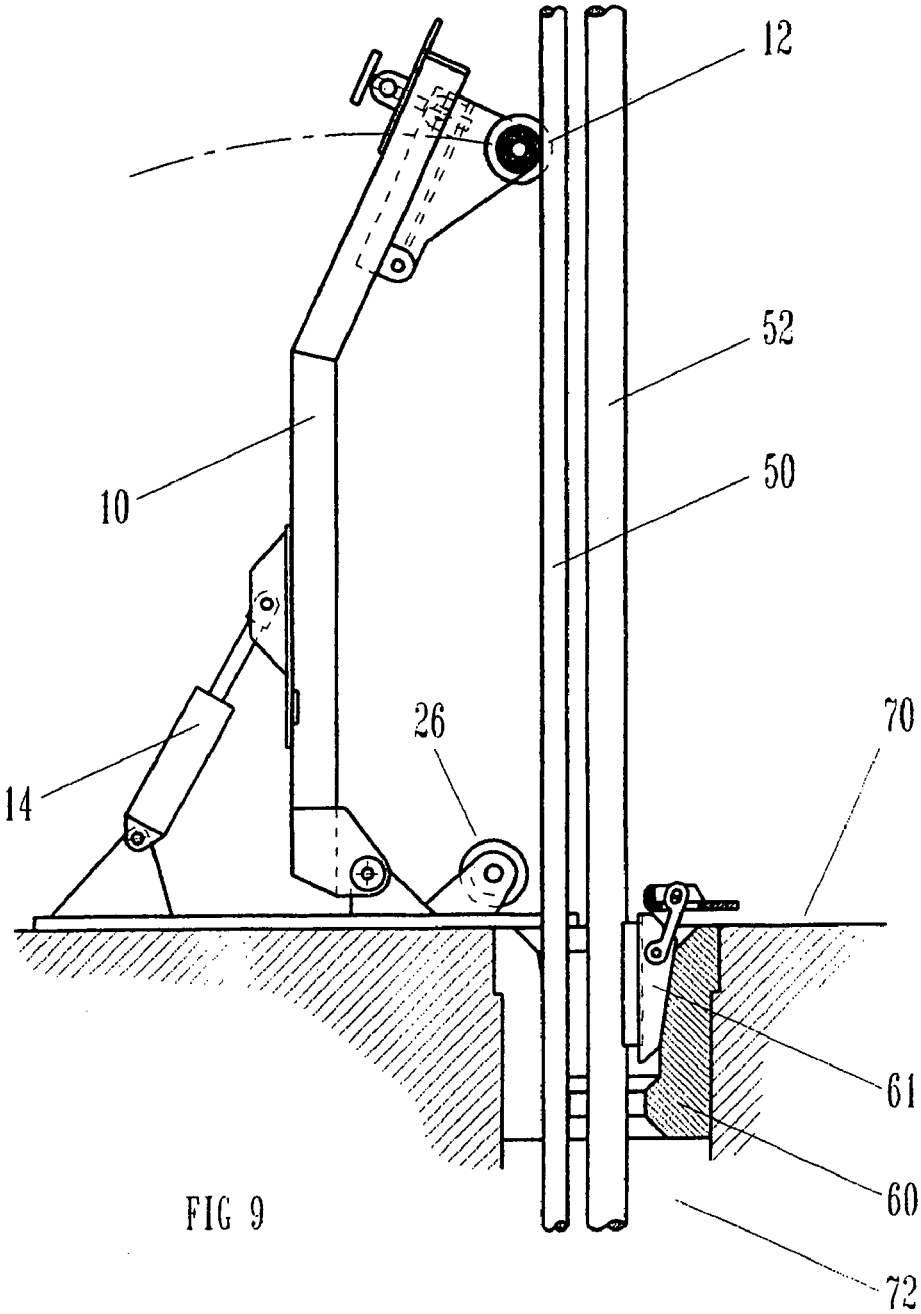
FIG 9

ARM FOR MOVING FLEXIBLE LINES AT A WELLSITE

RELATED CASE

This application is a continuation-in-part of Ser. No. 10/979,971 filed Nov. 3, 2004 now U.S. Pat. No. 7,201,233 which is a continuation of U.S. application Ser. No. 10/982,861 filed Sep. 24, 2004 now U.S. Pat. No. 7,610,965.

FIELD OF THE INVENTION

The present invention relates to an arm for engaging a flexible line, such as a control line, at a well site to position the line between a run-in position for passing the flexible line with the tubular through a well hole in the rig floor and a clamping position wherein the flexible line is adjacent the tubular for clamping the flexible line to the tubular. More particularly, the present invention relates to a moveable arm for engaging a flexible line at a well site, to a flexible line spacer for spacing a plurality of flexible lines with respect to each other for positioning the lines within a clamp which is secured to the tubular, and to a slip bowl assembly laterally movable relative to the well hole in the rig floor.

BACKGROUND OF THE INVENTION

Flexible lines, such as hydraulic, electrical or fiberoptic control lines coiled on a spool, are commonly run in a well with a tubular, thereby preventing the lines from substantial movement while in the annulus surrounding the tubular. These flexible control lines are commonly used to control the operation of various downhole equipment, including safety valves and subsea blowout preventers (BOPs). Control lines may be used to receive data from downhole instruments and to selectively operate downhole instruments, such as valves, switches, sensors and relays from the surface. Flexible lines may also be used for corrosion control or to treat fluids produced from the well. The control lines and the tubular may thus extend through the spider or slip bowl assembly used to support the tubular string from the rig floor. The lines are conventionally clamped to the tubular at the well site above the spider or slip bowl assembly which is positioned on the rig floor, so that the tubular string and the control lines together are run in the well.

A spider or slip bowl assembly is a device used on the drilling rig for grasping and supporting a tubular string as the tubular joints are made up into the string. A spider or slip bowl assembly has an interior bore and circumferentially arranged slips disposed around the string and within the interior bore. The slips move radially inward to grip the outer surface of the tubular and support the tubular in the well when the tubular string is not supported by an elevator. In some operations, it is practical to position the spider over the well hole to grip the tubular, and to move the spider laterally away from the well hole when running the tubular and the control lines into the well.

Various problems have existed for years in positioning the control lines for the clamps to secure the lines to the tubular while also allowing other apparatus, such as elevators and power tongs, to manipulate or operate on the tubular without damaging the control lines. The time required to position and clamp flexible lines to the tubular inherently delays the run-in process and may cost an operator tens of thousands of dollars in personnel costs and rig daily rental.

In one approach, a flexible line coiled on a drum may be guided by an arm extending generally downward from the rig mast, with a roller on the end of the arm. The roller may be spaced 25 feet or more above the rig floor, and positions the flexible line generally adjacent a perimeter of the tubular, so that the flexible line can extend down and be positioned within the clamp for clamping to the tubular. A significant problem with this arrangement is the cost of installing and properly adjusting the arm on the rig mast. Also, a flexible line extending downward from the roller may move laterally a foot or more from the vertical position of the roller, in which case manual labor by the rig hands is required to physically push or pull the line back to the position wherein the flexible line may be clamped to the tubular.

In view of the above problems, others have incurred the expense of inserting the flexible lines and clamping the lines to the tubular at a position below the spider or slip bowl assembly and above the rig floor. In this case, the spider is positioned a substantial distance above the rig floor to allow an operator sufficient space between the rig floor and the spider to clamp the control lines to the tubular. Examples of this technology are shown in U.S. Pat. No. 6,131,644 and U.S. 2004/00795338A1.

In offshore applications, it is frequently necessary to utilize several control lines with each tubing string. Multiple lines may be attached to the tubular in a circumferential arrangement that permits the lines to clear the slip segments in the spider or in the slip bowl assembly. When multiple lines are utilized, more time is required to position each line with respect to other lines so that all lines are properly positioned within the tubular clamp.

The disadvantages of prior art are overcome by the present invention, and improved equipment and techniques are provided for positioning a flexible line to be clamped to a tubular when the flexible line and tubular are run in the well.

SUMMARY OF THE INVENTION

In one embodiment, a moveable arm assembly for engaging a flexible line at a well site positions the flexible line between a run-in position spaced from the tubular above the rig floor for passing the flexible line with the tubular through a well hole in the rig floor, and a clamping position wherein the flexible line is adjacent the tubular above the rig floor for clamping the flexible line to the tubular. The moveable arm comprises an arm extending upward from the rig floor, at least one flexible line guide adjacent an upper end of the arm for engaging the flexible line when in the clamping position. A line guide pivot mechanism is provided for pivoting each line guide relative to the arm in a lateral direction. An arm swivel may be used for selectively rotating an upper portion of the arm relative to the base, such that the line guide pivot mechanism and the arm swivel may each be positioned for guiding a flexible line for connection with the tubular member.

In one embodiment, the flexible line guide is a roller rotatably mounted to the arm. A lower roller may also be provided for engaging the flexible arm when the arm is in the run-in position. A plurality of line guides may each be supported on the arm for engaging one or more flexible lines. At least one of the line guides may engage one circumferential side of the flexible line and another line guide may engage a circumferentially opposing side of the flexible line, such that a plurality of line guides effectively limit movement of the flexible line in a direction substantially along an axis of the flexible line. An arm swivel is provided for selectively rotating an upper portion of the arm relative to the base.

A significant advantage is that the time required to properly set up and adjust the arm is minimal. A further advantage is that the adjustable arm may be used with various types of slip bowl assemblies or spiders.

These and further features and advantages of the present invention will become apparent from the following detailed description, wherein reference is made to the figures in the accompanying drawings.

BRIEF DESCRIPTION OF THE DRAWINGS

FIG. 9 is yet another embodiment of an arm used with a flush mounted slip bowl assembly in the clamping position.

FIG. 10 is a top view of the slip bowl assembly shown in FIG. 9.

DETAILED DESCRIPTION OF PREFERRED EMBODIMENTS

Figure 1:
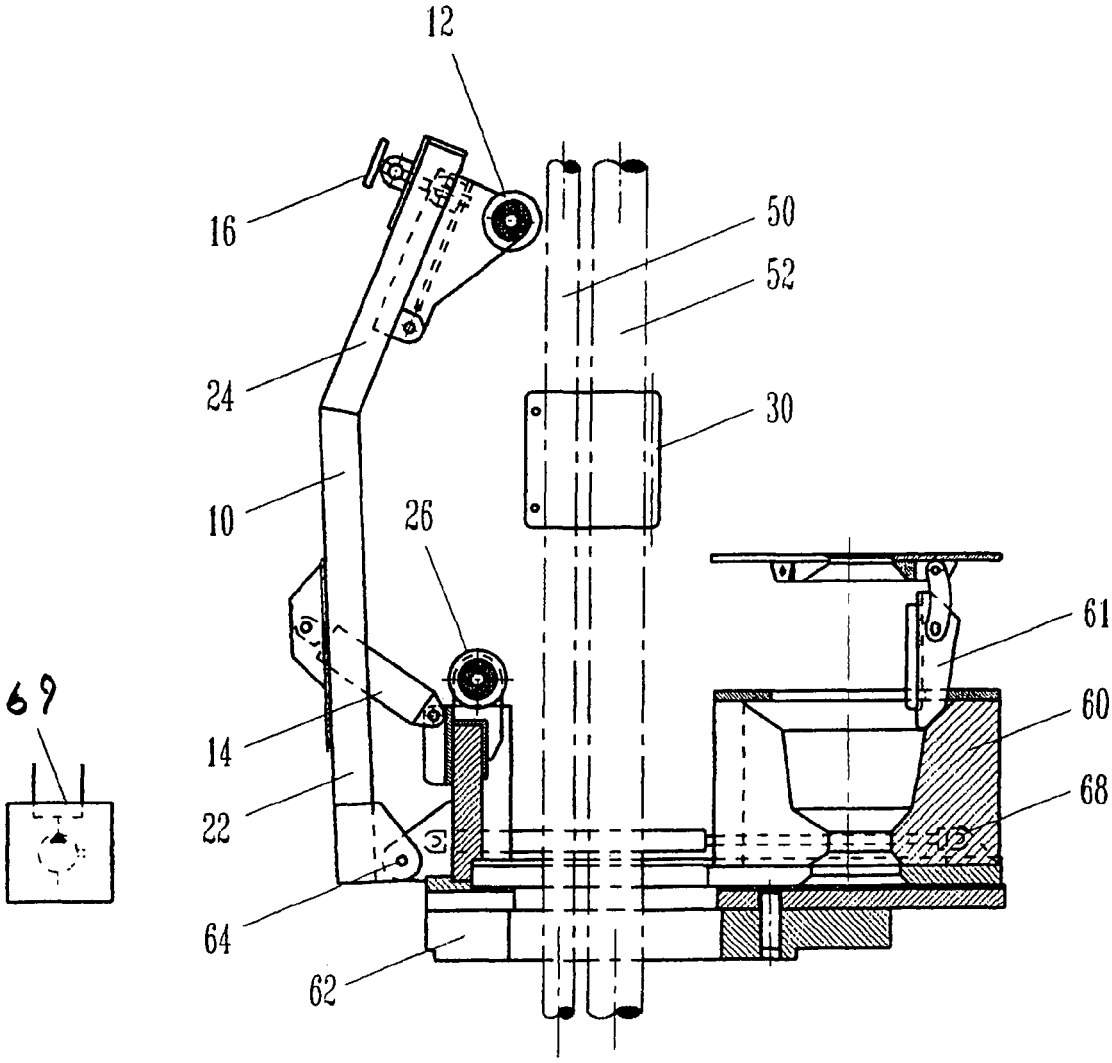
FIG. 1 is a side view of one embodiment of an arm according to the present invention, with the arm in the clamping position.
Figure 3:
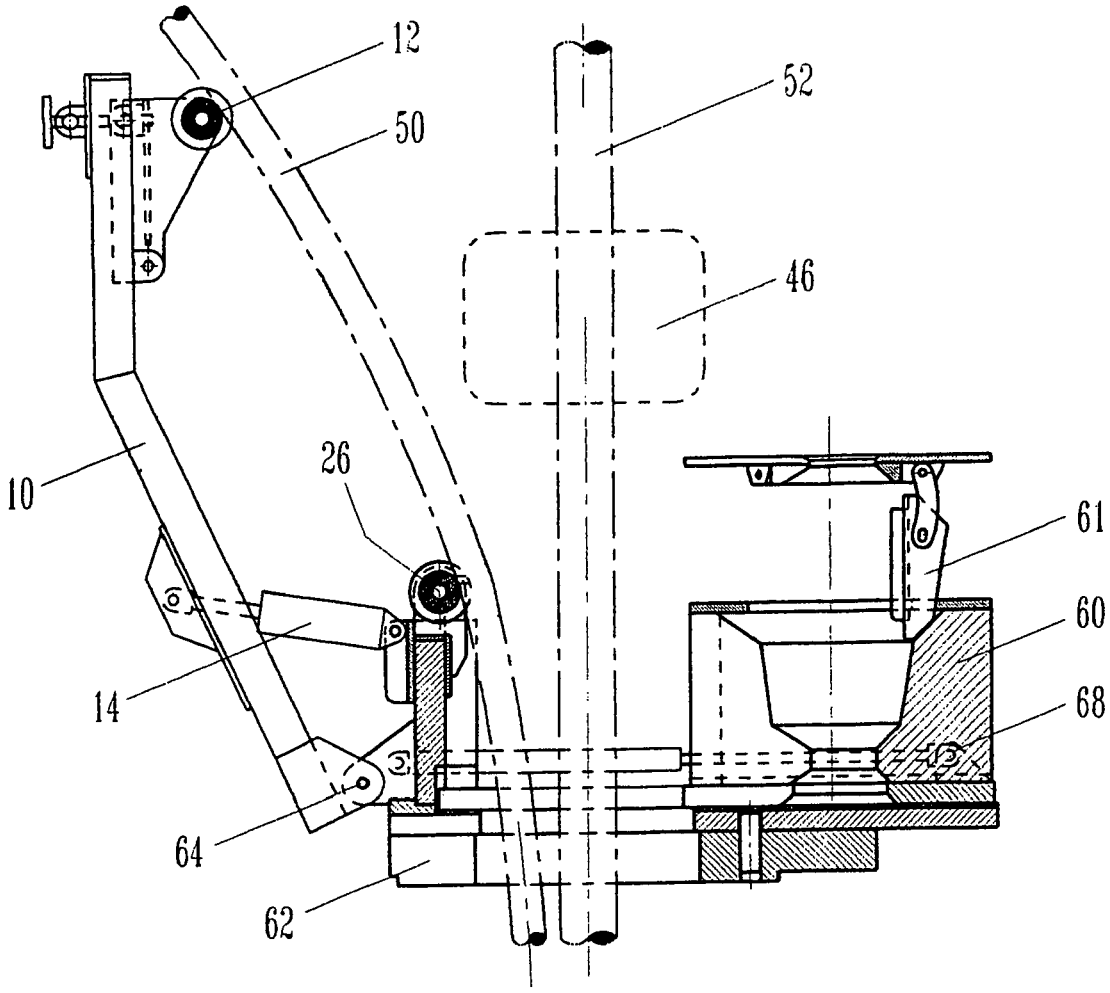
FIG. 3 depicts the embodiment of FIG. 1 in the run-in position.

FIG. 1 depicts one embodiment of a moveable arm 10 engaging a flexible line 50 at a well site for positioning the line between a clamping position, as shown in FIG. 1, for clamping the flexible line to a tubular 52, and a run-in position, as shown in FIG. 3, wherein the flexible line is spaced from the tubular for allowing equipment to engage the tubular and to run the flexible line with the tubular into the well. As shown in FIG. 1, the moveable arm 10 extends upward from the rig floor on which the base or plate 62 of the slip bowl assembly 60 is positioned. Arm 10 includes a lower arm portion 22 which is pivotally connected at 64 to the base or plate 62 of the slip bowl assembly 60, and an upper arm portion 24 which is inclined or canted relative to lower arm portion 22. A roller 12 is pivotally mounted on the upper arm portion 24, and serves as a flexible line guide for engaging the flexible line 50 when in the run-in position. The adjustment mechanism 16 comprising a threaded rod and a rotating handle may be used for adjusting the position of roller 12 relative to the arm. Other adjustment mechanisms may be used for adjusting the position of roller 12. Movement of the arm between the position as shown in FIG. 1 and the position as shown in FIG. 3 is accomplished by a powered drive, which preferably is a hydraulic cylinder 14, which acts between the base or plate 62 of the slip bowl assembly and the lower portion of the arm 10. A lower roller 26 is provided in engaging the flexible line 50 when the arm is in the run-in position, as shown in FIG. 3.

Figure 2:
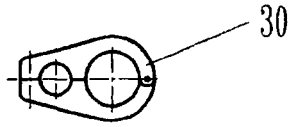
FIG. 2 is a top view of the clamp shown in FIG. 1.

With the flexible line 50 properly positioned by the arm and the roller 12, a suitable clamp, such as clamp 30 shown in FIG. 2, may be clamped about the tubular 52 and about the flexible line 50, thereby securing the flexible line in position to the tubular so that both the tubular 52 and the flexible line 50 are run together in the well. After the clamp 30 is installed, the spider or slip bowl assembly 60 may be moved laterally from the centerline of the well. Alternatively, the slip bowl assembly 60 may be off the well centerline when the clamp is installed. The slip bowl assembly is centered over the well when tongs make up the pipe. FIG. 1 shows a slip bowl assembly 60 moved laterally off its position over the well hole in the rig floor. Those skilled in the art will appreciate that hydraulic cylinder 68 or other drive mechanism may be actuated to laterally move the slip bowl assembly to the position spaced from the well hole, as shown in FIG. 1, and to return the slip bowl assembly to a position centered over the well hole to grip the tubular. Those skilled in the art will further appreciate that the line 50 as shown in FIG. 1 is a substantially flexible line compared to the rigid tubular 52, and may comprise one or more electric, hydraulic or fiberoptic lines.

In a preferred embodiment, hydraulic system 69 as shown in FIG. 1 may be used to power both the cylinder 68 for translation of the slip bowl assembly 60, and the cylinder 14 for moving the hydraulic arm 10. A feature of the invention is that the roller or other guide member 12 at the end of the arm for engaging and guiding the flexible line 50 when in the clamping position is positioned fairly close to the rig floor. In a preferred embodiment, the roller 12 is positioned approximately 10 feet or less from the rig floor in the clamping position, thereby providing sufficient room for an operator to position the clamp 30 on the tubular 52 and the flexible line 50, while also realizing a fairly short spacing, typically three or four feet or less, between the top of the clamp 30 and the roller 12 at the upper end of the arm 10, thereby ensuring that the flexible line 50 does not move laterally a substantial distance from the position obtained by the roller 12 to the position when the clamp 30 clamps the flexible line to the tubular 52. Those skilled in the art will appreciate that a single hydraulic system 69 may power the slip bowl assembly and the arm 10 from each of the embodiments shown.

FIG. 3 shows the arm 10 moved to a run-in position so that tongs, elevators and other tools can engage and operate on the tubular 52 without damaging the flexible line 50, which conventionally extends from a reel as shown subsequently into the well. An exemplary tool 46 is shown in the dashed lines in FIG. 3 for working on the tubular string. When the tubular and flexible lines are run in a well, the slip bowl assembly 60 is preferably laterally spaced from the well hole to prevent damage to the control lines. The tubular 52 and lines 50 pass through a slip bowl setting plate 62 when the slip bowl assembly 60 is spaced from the well hole.

Figure 6:
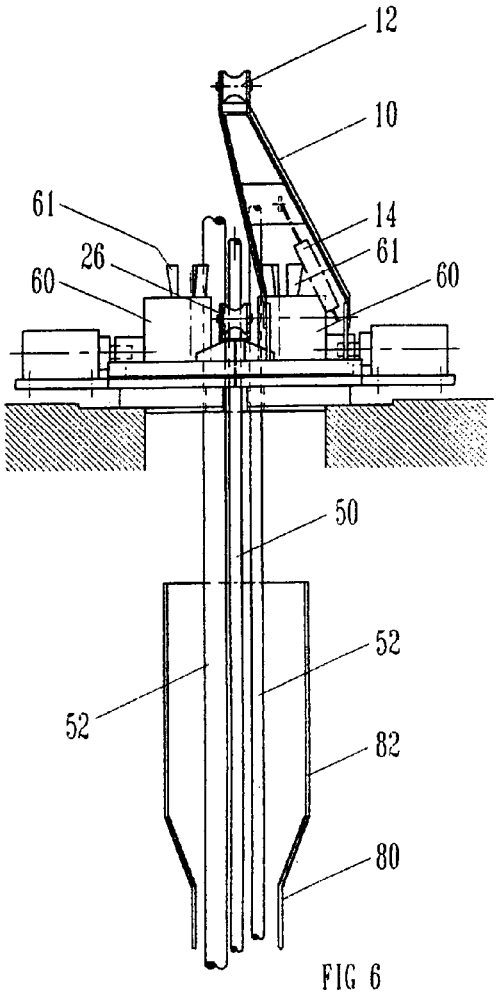
FIG. 6 is the FIG. 4 embodiment in the run-in position.
Figure 4:
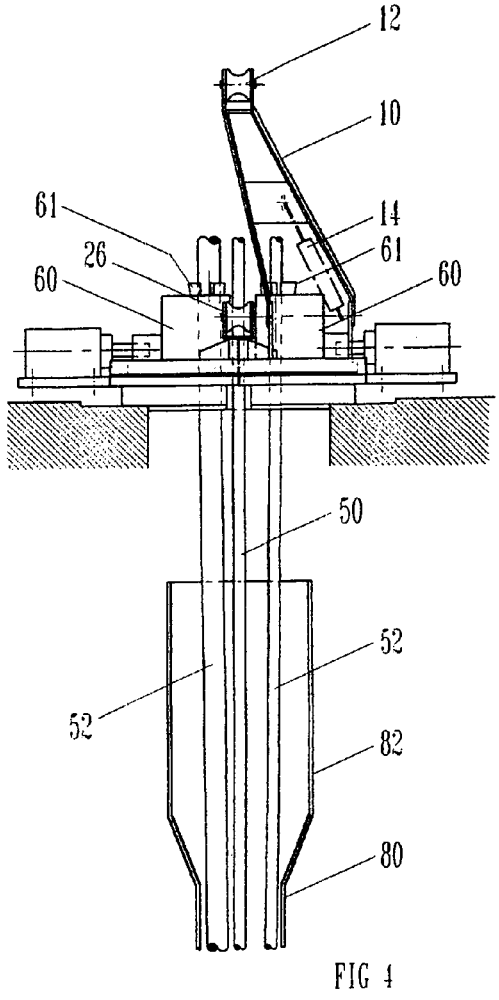
FIG. 4 depicts another embodiment of an arm in the clamping position.

FIG. 4 depicts an alternate embodiment of an arm 10 including an upper roller 12 for engaging a flexible line, and a roller 26 positioned approximately two feet above the rig floor 70. With the embodiment as shown in FIG. 4, the flexible line 50 is substantially angled beneath the rig floor 70 when in the run-in position, as shown in FIG. 6, and accordingly the conductor or outer casing 80 has an enlarged upper section 82 for accommodating the bend of the flexible line 50, as shown in FIGS. 4 and 6. In the FIG. 4 embodiment, the arm 10 comprises a pair of arm members which are pivotally connected to a base of the slip bowl assembly and support the upper roller 12.

Figure 5:
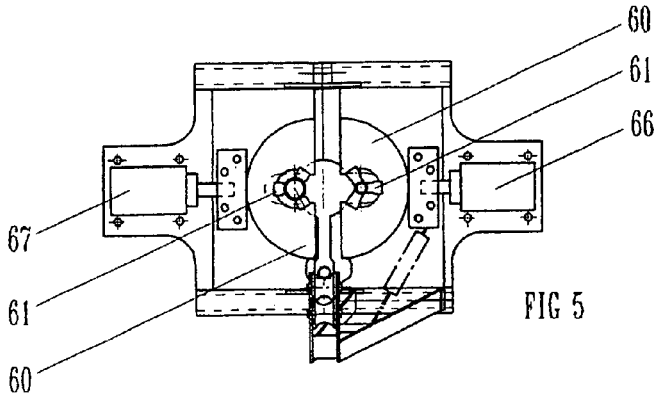
FIG. 5 is a top view of the FIG. 4 embodiment.

FIG. 5 depicts a slip bowl assembly 60 which, in this case, is a split bowl assembly, such that the hydraulic cylinder 66 may be activated to move the right side of the slip bowl assembly laterally to the right, while the cylinder 67 may be similarly actuated to move the left side of the slip bowl assembly to the left.

Figure 7:
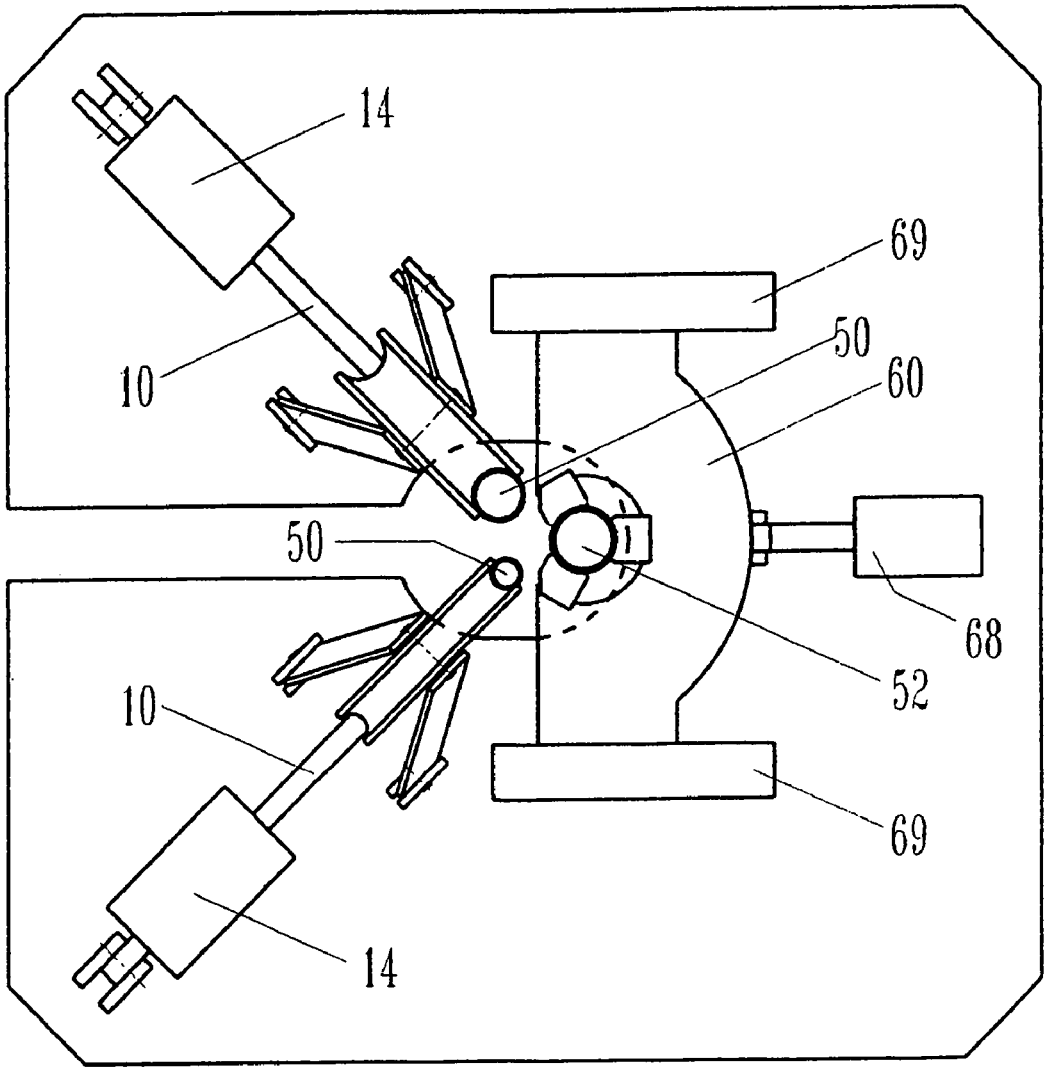
FIG. 7 is a top view illustrating two arms each for positioning a flexible line above a spider.

FIG. 7 illustrates an embodiment wherein a pair of arms 10 are each provided with a powered cylinder 14 for positioning two different flexible lines 50 relative to the tubular 52. The slip bowl assembly 60 is positioned between guides 69 and is powered by cylinder 68 to move laterally on and off the tubular 52.

Figure 8:
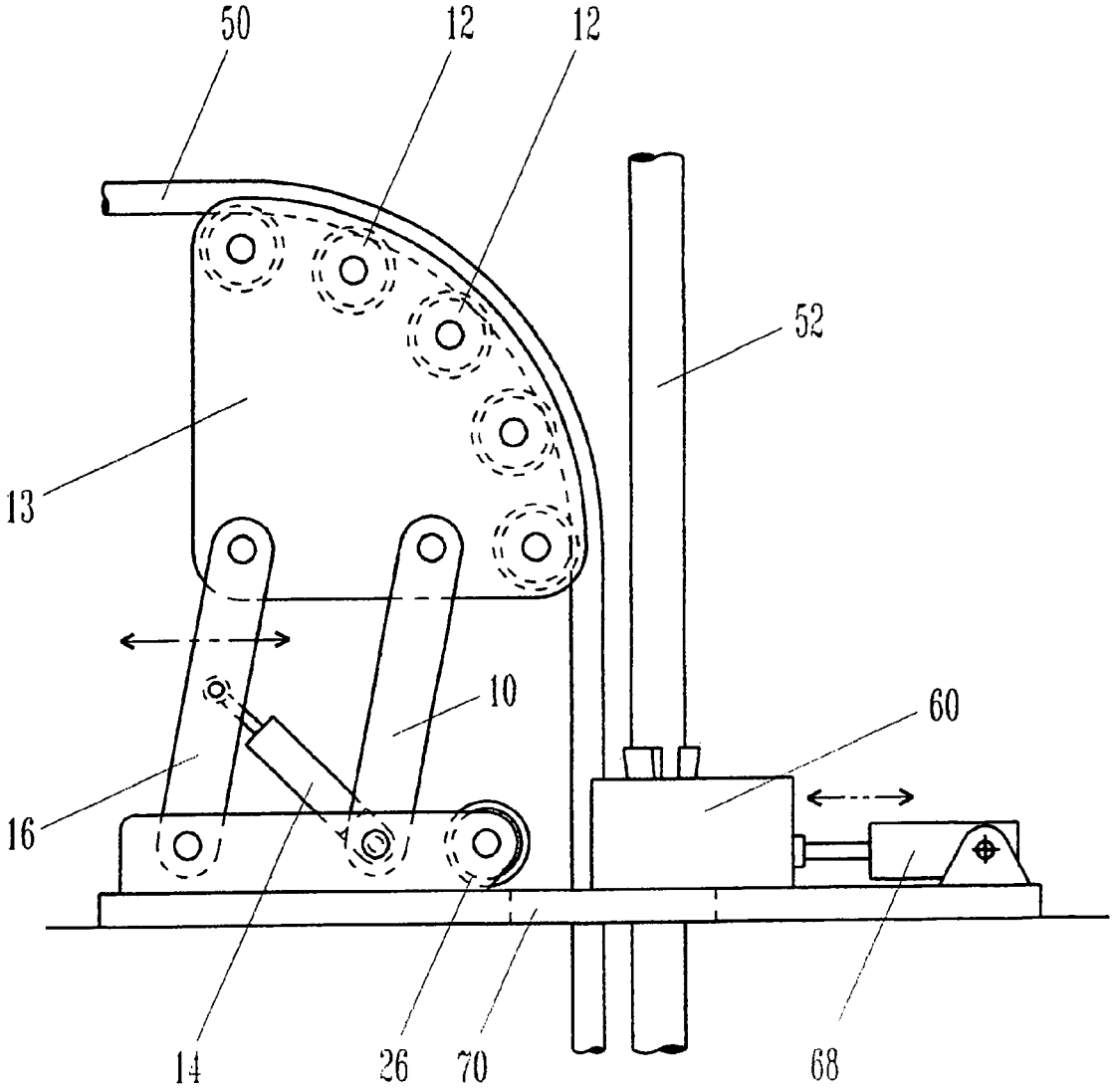
FIG. 8 depicts another embodiment of an arm for guiding a flexible line.

FIG. 8 discloses an alternate embodiment, when the flexible line 50 is guided by a plurality of rollers 12 each mounted on roller support 13 provided at the upper end of two arms 10, with hydraulic cylinder 14 controlling movement of the arms and thus movement of the rollers 12 between the clamping position, shown in FIG. 8, and the run-in position. The slip bowl assembly 60 may be moved laterally relative to the rig floor by the powered cylinder 68 from a position wherein the assembly 60 is centered over the well hole in the rig floor to a position wherein the slip bowl assembly is laterally spaced from the well hole.

FIG. 9 discloses yet another embodiment of an arm assembly 10 powered by hydraulic cylinder 14 for moving flexible line 50 into a clamping position adjacent the tubular 52. A lower roller 26 is provided for engaging the flexible line 50 when in the run-in position. In this application, the slip bowl assembly 60 is placed within the rig floor, and the top of the slip bowl assembly 60 is substantially flush with the top of the rig floor 70. Both the tubular 52 and the flexible line 50 thus pass through the rig floor and into the well hole 72 in the rig floor. FIG. 10 is a top view showing the slips 61 of slip bowl assembly 60 and the position of the tubular 52 and the flexible line 50. Slips are not shown in all figures, but those skilled in the art will appreciate that slips are conventionally provided within each of the slip bowls shown.

Figure 11:
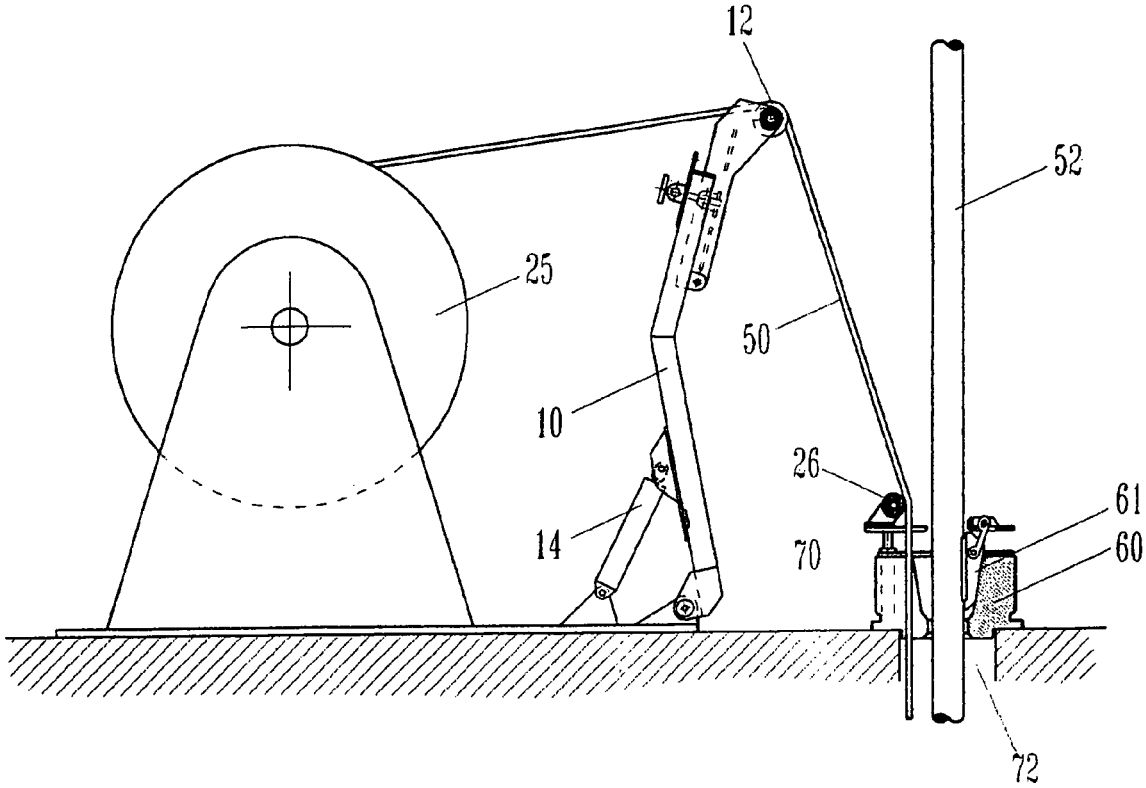
FIG. 11 is a side view of an arm supported on the rig floor in the run-in position.

In the FIG. 11 embodiment, the flexible line engages the roller 12 at the top of arm 10, and continues to the reel 25 on which the flexible line is coiled. In this position, line 50 engages lower roller 26. The arm 10 is thus supported on the top of the rig floor 70, and the slip bowl assembly 60 is centered above the rig floor 70 and over the well hole 72.

Figure 12:
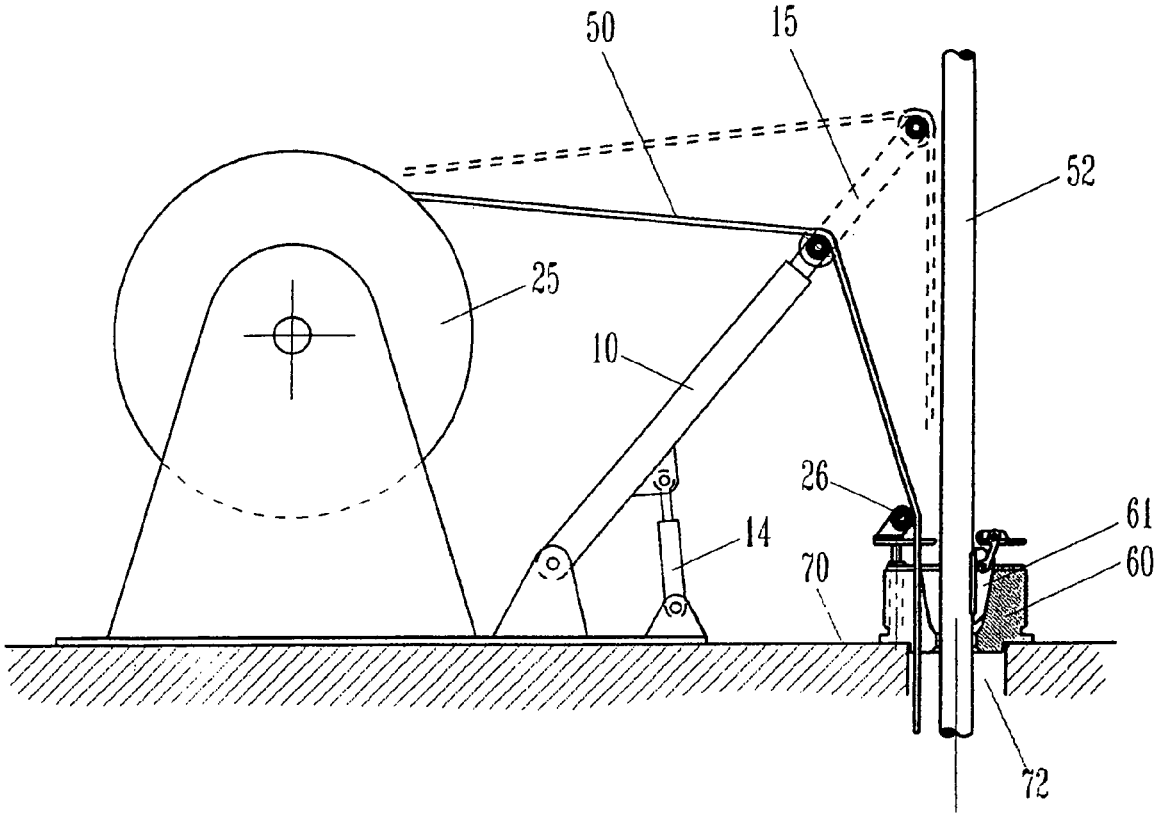
FIG. 12 is a side view of an alternate embodiment illustrating an extendable arm.
Figure 14:
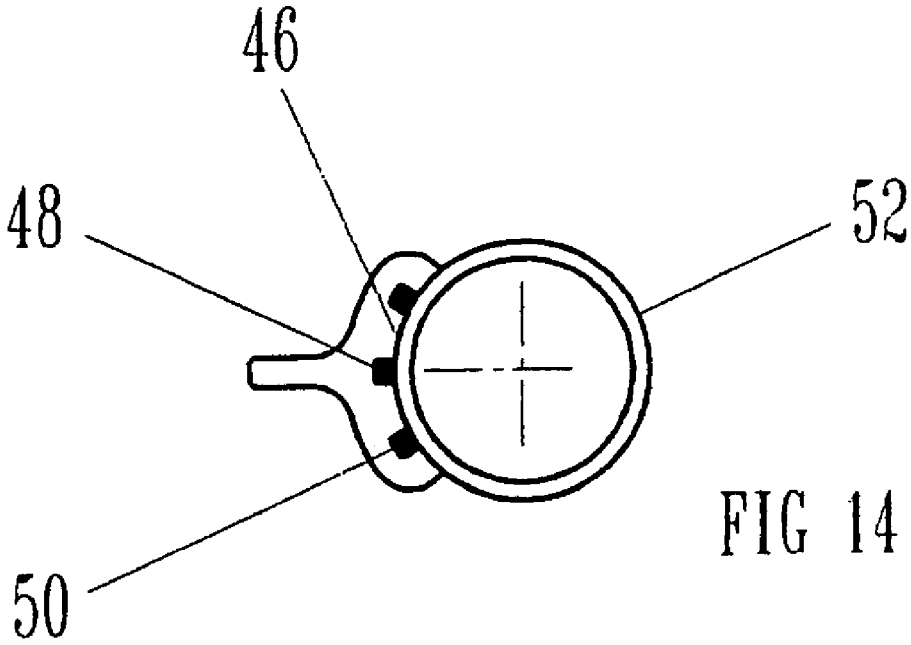
FIG. 14 is a top view of the spacer shown in FIG. 13.

FIG. 12 illustrates another embodiment of an arm assembly 10, which in this case is extendable from a run-in position, as shown in solid lines, to a clamping position for passing the flexible line 50 and tubular 52 simultaneously through the slip bowl assembly 60 centered over the well hole 72 in the rig floor 70. Both the arm assembly 10 and the reel 25 are thus provided on the rig floor 70. Hydraulic cylinder 14 controls the angular position of the arm assembly 10, while hydraulic cylinder 15 within the arm assembly 10 controls the extension and retraction of the arm between the clamping position and the run-in position. A lower roller 26 is provided on the upper end of the slip bowl assembly 60 for engaging the flexible line when in the run-in position. In alternate embodiments, the telescoping arm 10 as shown in FIG. 12 may be moved by a rack and pinion assembly or a powered cable system. A cylinder 14 effectively adjusts the angle of the arm 10, and the extension and retraction movement of the arm may be controlled by a hydraulic cylinder, a powered screw, or a plate with adjusting pin holes. The slip bowl assemblies shown in FIGS. 9, 11 and 12 are not laterally movable relative to the rig floor. In a preferred assembly, the slip bowl assembly is laterally movable, as discussed above.

The term "run-in position" as used herein is the position of the arm when passing the flexible line with a tubular through the well hole in the rig floor. The run-in operation typically includes a stage wherein power tongs or other equipment are used to threadably connect one tubular joint to another tubular joint, and also includes the operation of lowering the tubular with an elevator so that the elevator is positioned only several feet above the rig floor. During both of these operations, it is preferable that the flexible lines and the arm 10 be laterally spaced from the power tongs or the elevators, so that the lines are not damaged during these stages of the run-in operation. During part of the run-in operation, the flexible lines could be positioned adjacent the tubular, although it may be more practical for many applications to have the arm space the flexible lines from the tubular during the entire run-in operation, so that the run-in operation need not be interrupted by movement of the flexible lines to a position spaced form the tubular when the elevators are lowered or the tongs are used to make up a tubular connection. The slip bowl assembly 60 may thus be centered over the well hole when tongs make up a tubular connection, but the assembly 60 is moved laterally from the well hole when the elevators are lowered and the tubular is run in the hole with the flexible lines.

Figure 13:
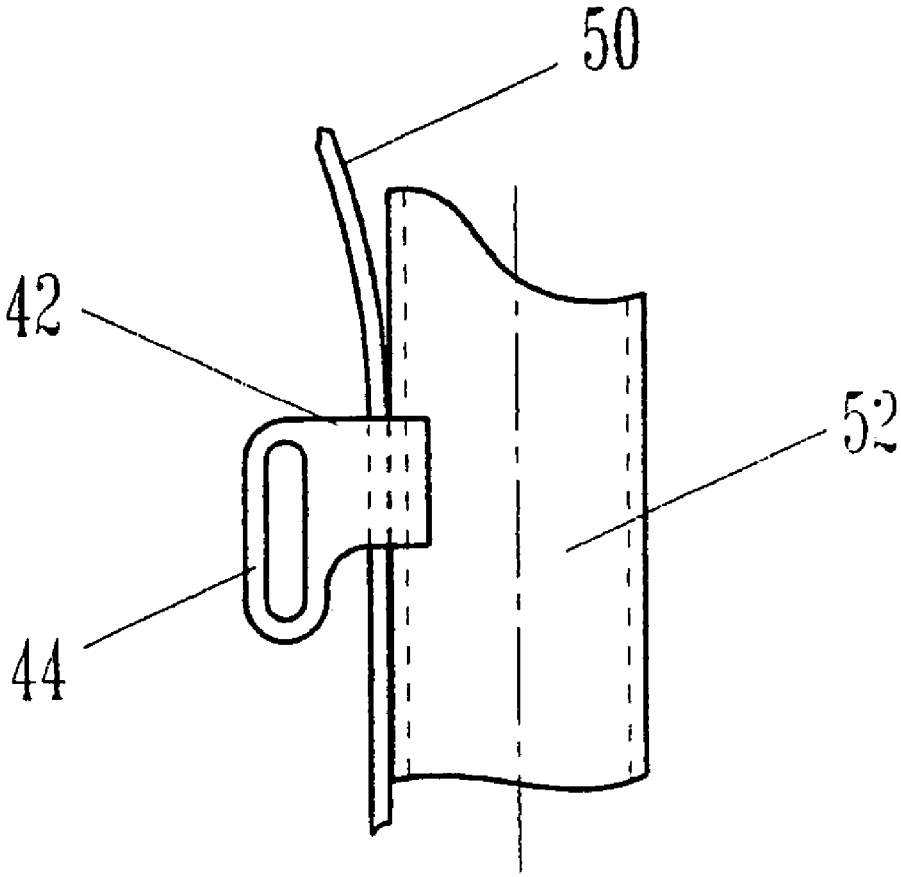
FIG. 13 depicts a flexible line spacer.

FIG. 13 illustrates the hand held line guide 42 for positioning a plurality of flexible lines 50 at a desired spacing relative to one another prior to clamping the flexible lines to the tubular 52. The guide 42 includes a handle 44 for manually grasping and manipulating the guide, and has a curved surface 46 for substantially planar contact with the outer diameter of the tubular 52. A plurality of elongate cavities 48 are provided along the curved surface 46, with each cavity 48 being sized to receive a selected one of the flexible lines 50, whether those flexible lines have a substantially circular or rectangular configuration. By using the line guide 42, an operator can properly position the flexible lines at their desired spacing relative to one another and press the flexible lines in position against the tubular 52, so that the flexible lines will be properly positioned for being received within the clamp 30 shown in FIG. 2 for final clamping of the flexible lines to the tubular 52.

Figure 16:
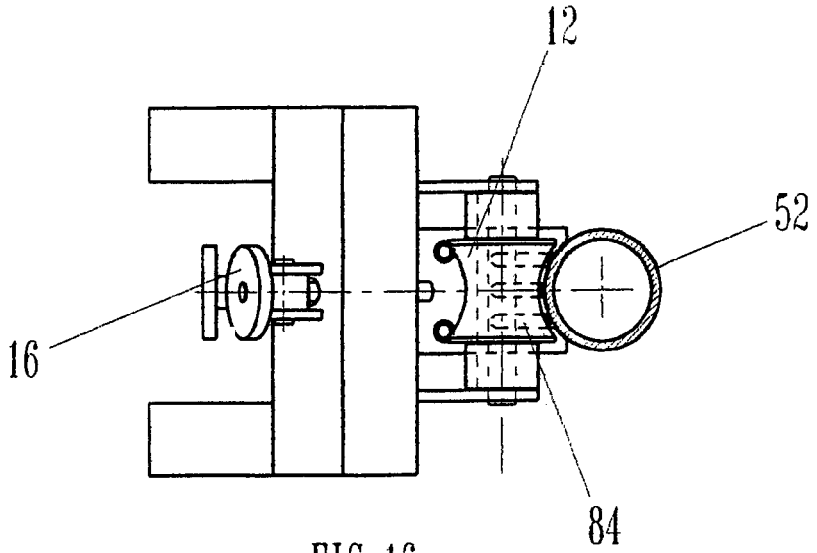
FIG. 16 is the top view of the embodiment shown in FIG. 15.
Figure 17:
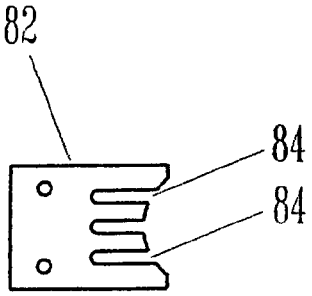
FIG. 17 is a top view of the line spacer generally shown in FIG. 15.
Figure 15:
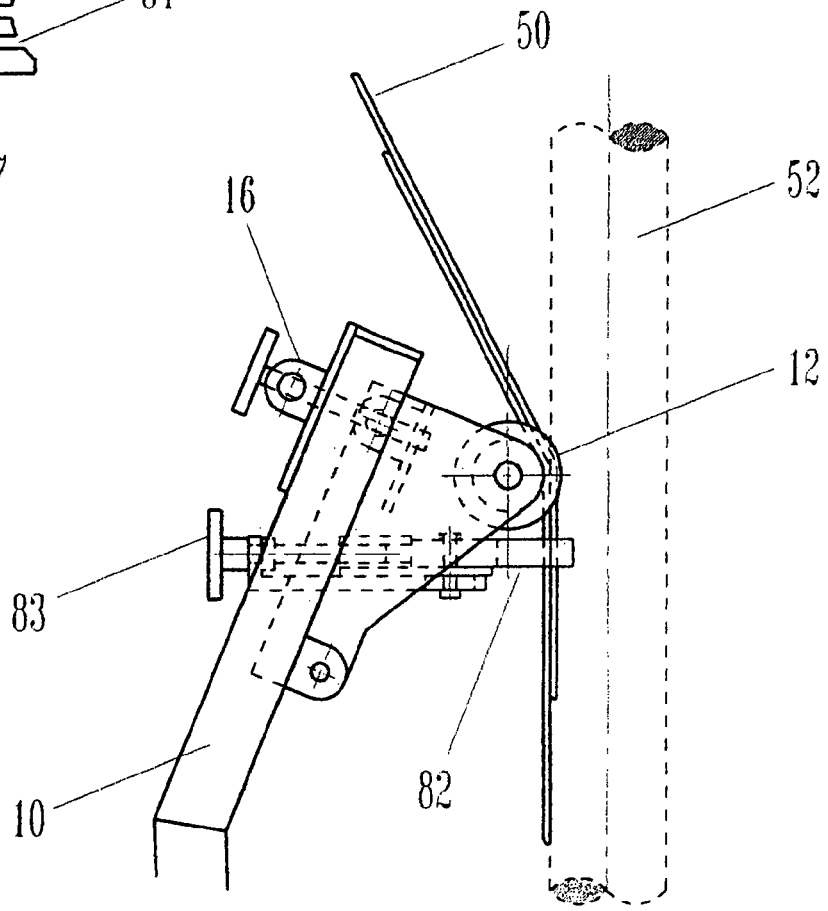
FIG. 15 is a side view of an upper portion of an arm with a line spacer adjustably positioned on the arm beneath a roller.

FIG. 15 is a side view of an upper portion of an arm 10 with a roller 12 adjustable relative to the arm by adjustment mechanism 16. The roller engages the plurality of flexible control lines 50 and positions the lines 50 adjacent the tubular for clamping the lines to the tubular with a conventional clamp. FIG. 15 also depicts a flexible line spacer 82 supported on the upper end of the arm, with the position of a flexible line spacer 82 being adjustable by adjustment mechanism 83. The line spacer 82 may be fabricated from a high wear plastic, such as ultra high molecular weight polyethylene, or may be fabricated from steel. Spacer 82 allows the flexible lines to stay on the roller when the arm 10 is moved away from the pipe, at which time the flexible lines will move back toward the rear of the slots 84, as shown in FIG. 17. The position of the roller 12 with respect to the flexible line spacer may thus be adjusted so that the flexible lines may be spaced a slight distance off the surface of the tubular 52 and still contact the roller 12. The slots 84 in the flexible line spacer 82 are shown in both the top view of FIG. 16 and the top view of the flexible line spacer as shown in FIG. 17. The width of the slot 84 may be greater than a width of a respective flexible line to minimize wear on the flexible line. In another embodiment, the flexible line spacer is movable by a fluid powered cylinder between a retracted position on the arm wherein the spacer is out of contact with the flexible lines, and an extended position wherein the flexible lines are positioned within the spacer slots. The flexible lines may be manipulated by an operator at the rig floor, if necessary, to slide within a respective spacer slot.

Figure 19:
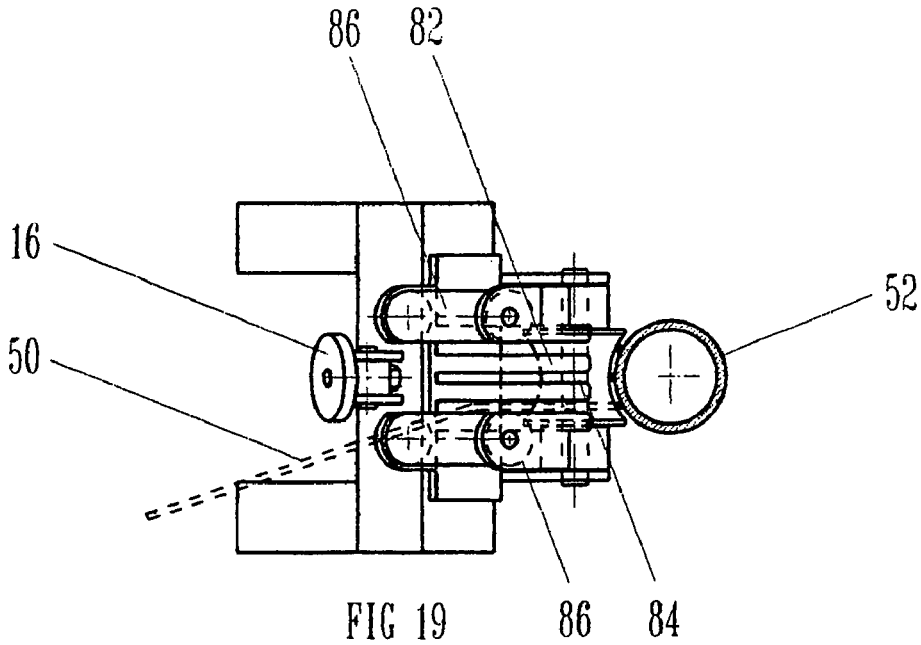
FIG. 19 is a top view of the embodiment shown in FIG. 18.
Figure 18:
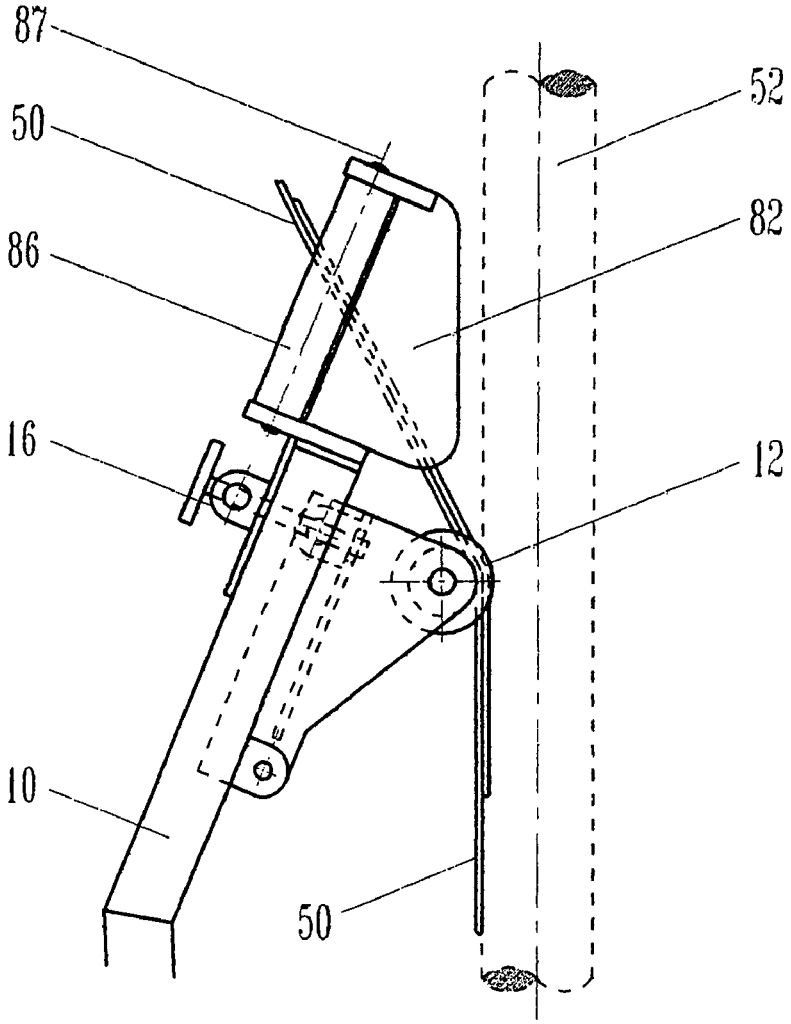
FIG. 18 is a side view of an upper portion of an arm with a line spacer positioned above the roller at the upper end of the arm.

FIG. 18 is a side view of an alternate embodiment, wherein a flexible line spacer 84 is positioned above the roller 12. As shown in FIG. 19, slots 84 in the flexible line spacer are provided, with each slot receiving one of the flexible lines 50. A plurality of rollers 86 with a substantially vertical component axis 87 are provided for guiding the flexible line 50 into position for being received with a respective slot 84 in the spacer 82, then subsequently engaged by the roller 12. When the flexible line from the spool is not in line with the arm 10, rollers 86 thus guide each of the flexible lines for passing through a respective slot in the spacer 82 prior to engaging roller 12.

Figure 21:
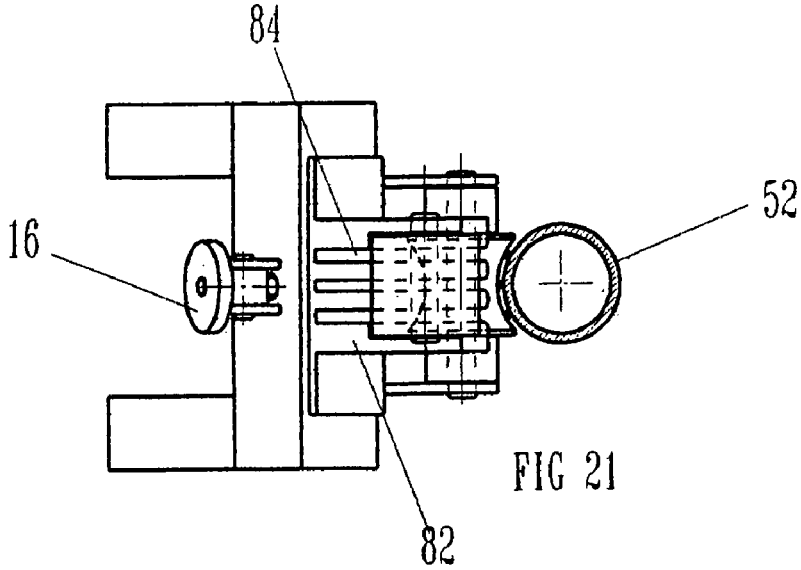
FIG. 21 is a top view of the embodiment shown in FIG. 20.
Figure 20:
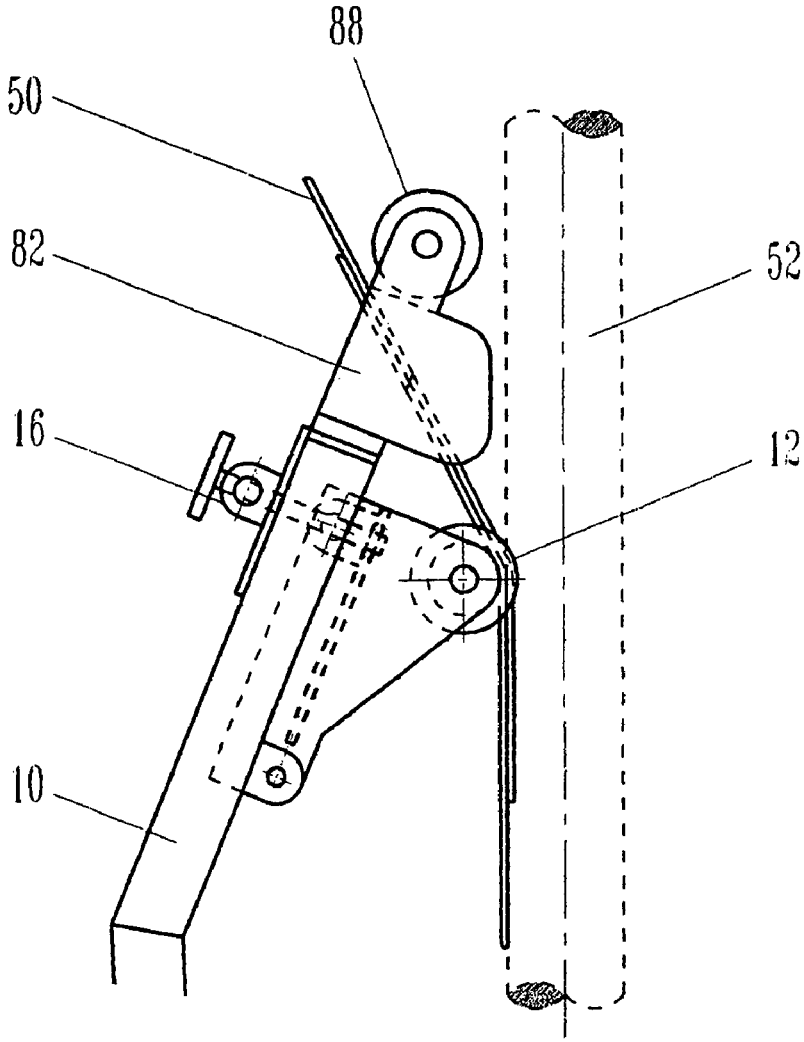
FIG. 20 is a side view of yet another embodiment depicting an upper portion of an arm, a line spacer above the roller, and another roller above the line spacer.

FIG. 20 depicts another embodiment wherein flexible line spacer 82 is provided on the arm 10 above the roller 12. With this embodiment, the top roller 88 above the spacer 82 is also provided to prevent lines from coming out of the slots in the spacer 82 when the arm is moved away from the tubular 52. FIG. 21 depicts the slots 84 in the spacer 82.

Figure 23:
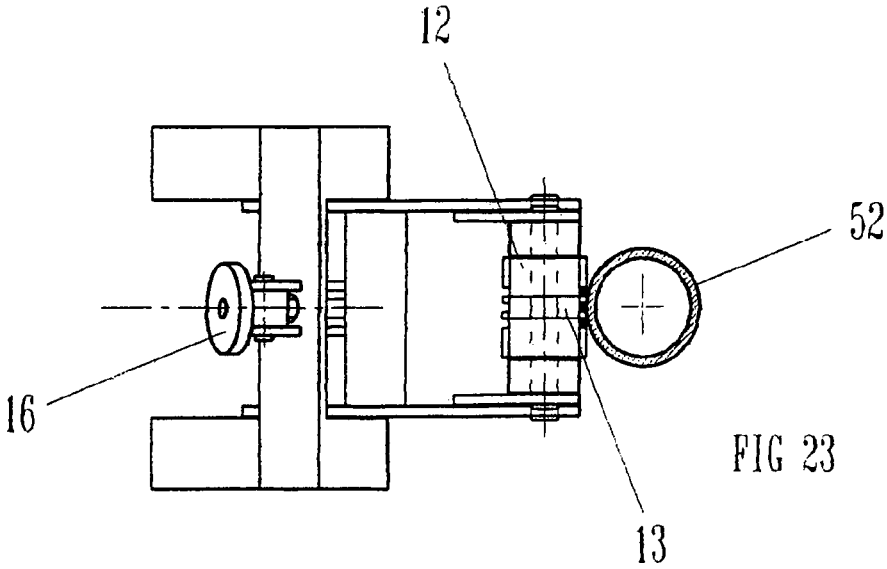
FIG. 23 is a top view of the embodiment shown in FIG. 22.
Figure 22:
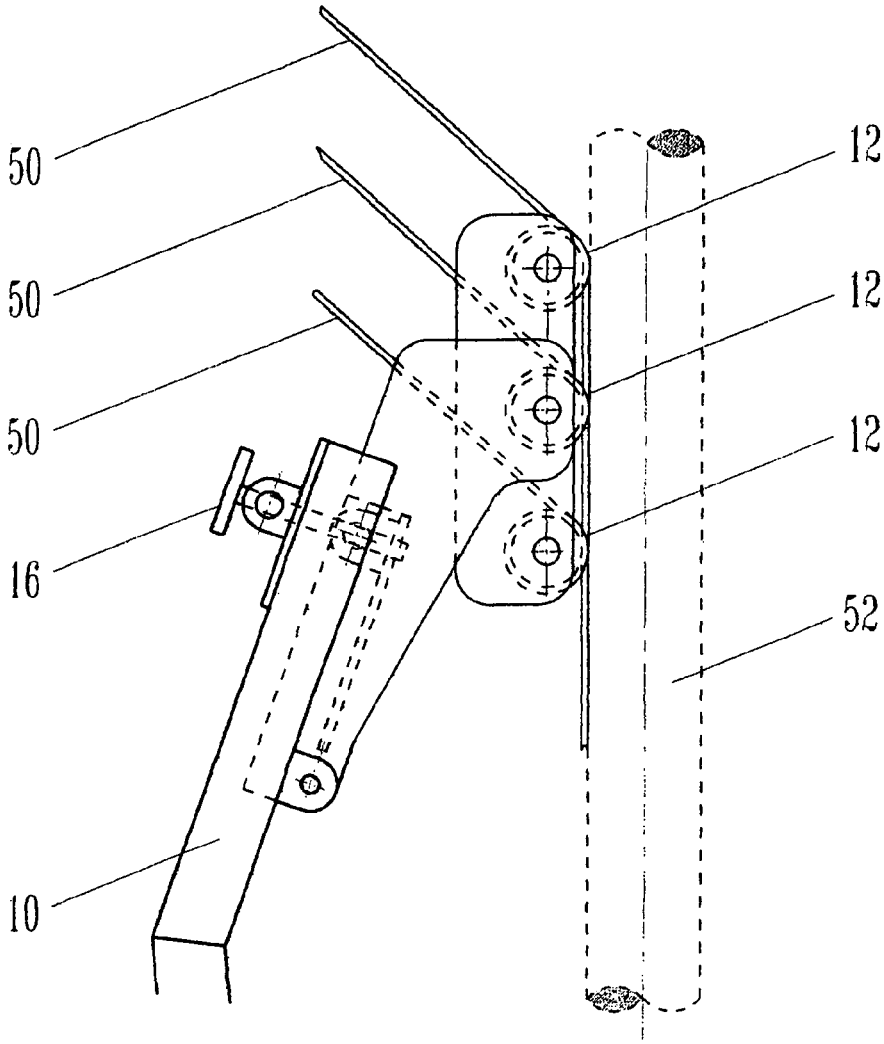
FIG. 22 is a side view of an upper portion of an arm depicting a plurality of vertically spaced rollers, with each roller receiving one of the plurality of flexible lines.

FIG. 22 discloses an alternate embodiment, wherein the upper portion of the flexible arm 10 supports a plurality of rollers 12, with each roller being provided on a respective shaft. Each roller thus engages one of the plurality of flexible lines, and positions the lines 50 against the tubular 52 for clamping the lines to the tubular. If desired, each roller 12 may include a groove 13 as shown in FIG. 23 for receiving a respective flexible line.

For each of the embodiments disclosed herein, different types and styles of line guides and flexible line spacers may be used. For example, rollers 86 as shown in FIGS. 18 and 19 thus may be provided for each of the embodiments depicted. The flexible line spacer may have various configurations and may be mounted in different positions on the arm depending on the location of the spools which store the flexible lines.

Figure 24:
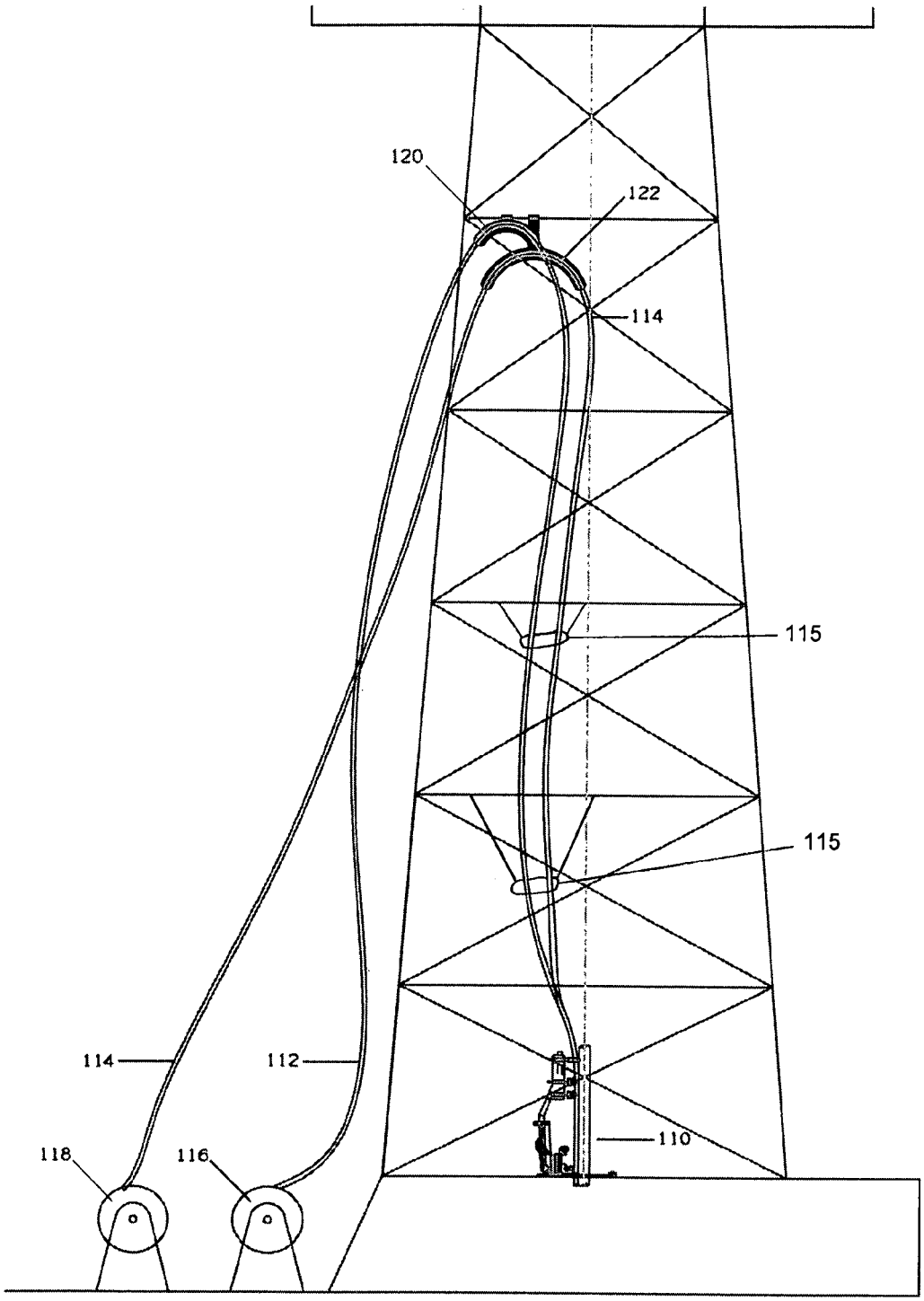
FIG. 24 is a side view of another embodiment of an arm assembly for guiding flexible lines.

FIG. 24 illustrates an arm assembly 10 for guiding flexible lines 112 and 114 from spools 116 and 118, respectively to the tubular. An arch guide 120 supported on the rig initially guides line 112, and a similar arch guide 122 guides line 114. A plurality of umbilical line hoops 115 may optionally be provided above the arm assembly, as shown in FIG. 24, to guide and bundle a plurality of flexible lines prior to engagement by the arm assembly. An upper hoop and a lower hoop 115 are thus depicted in FIG. 24, with each hoop tied off to the rig structure. The arm assembly 110 is thus provided on the rig floor about a well and guides one or more flexible lines for connection to and disconnection from a tubular member.

Figure 25:
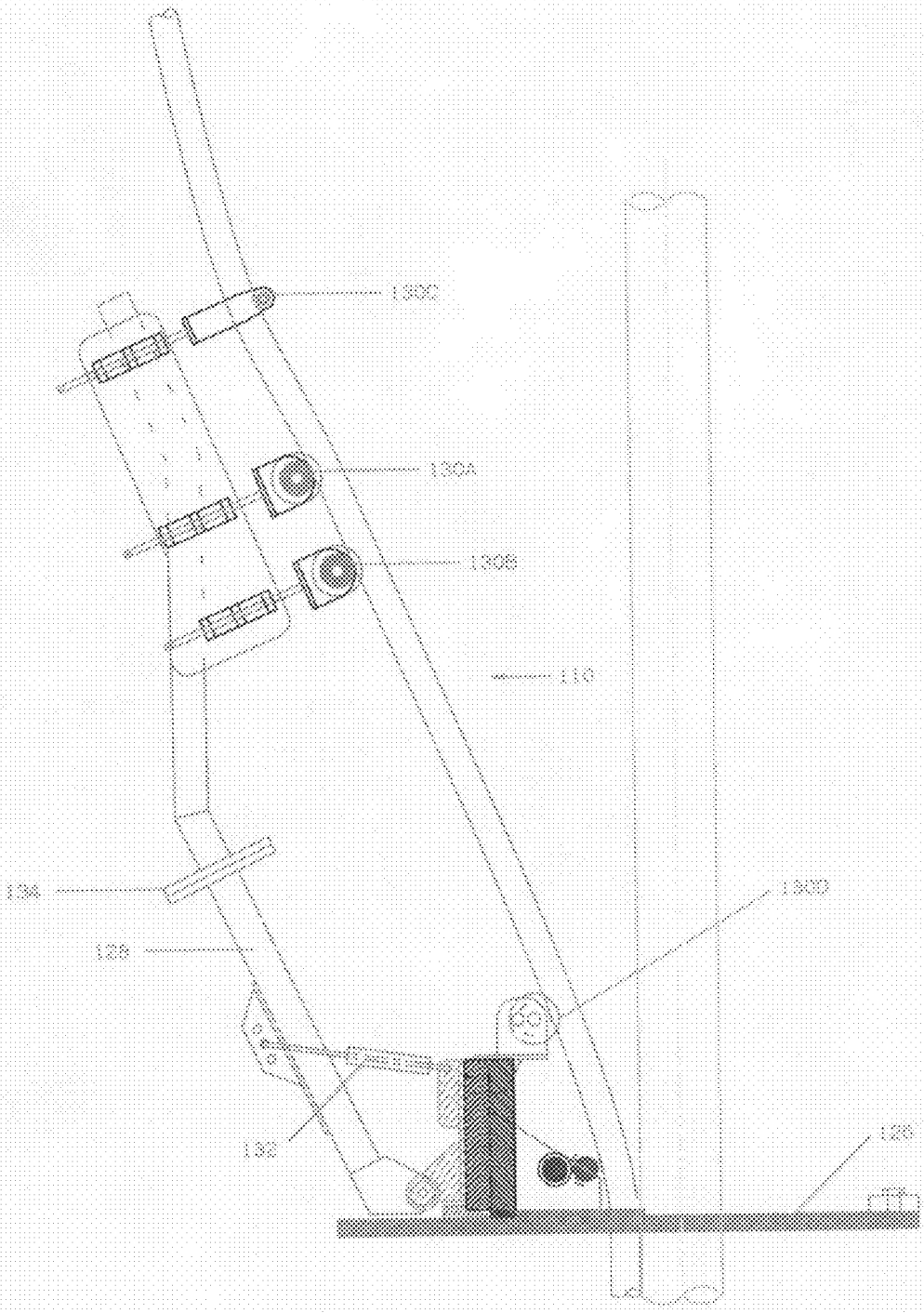
FIG. 25 is a side view of a simplified arm assembly in the run-in position.

FIG. 25 depicts an arm assembly 110 and base 126 positioned on the well floor in the run-in position. Moveable arm 128 extends upward from the base, and may be telescopic. One or more line guides 130, which may each be in the form of a roller, guide one or more flexible lines toward and away from the tubular.

As shown in FIG. 25, line guides 130A and 130B engage one circumferential side of the flexible line, and another line guide 130C, in this case the uppermost line guide, engages a circumferentially opposite side of the flexible line. The combination of line guides thus effectively trap the flexible line in place, and prevent movement of the flexible line in any direction not substantially coaxial with an axis of the flexible line. FIG. 25 also depicts a lower guide member 130D, which may only engage the flexible line in the position shown in FIG. 25.

Figure 26:
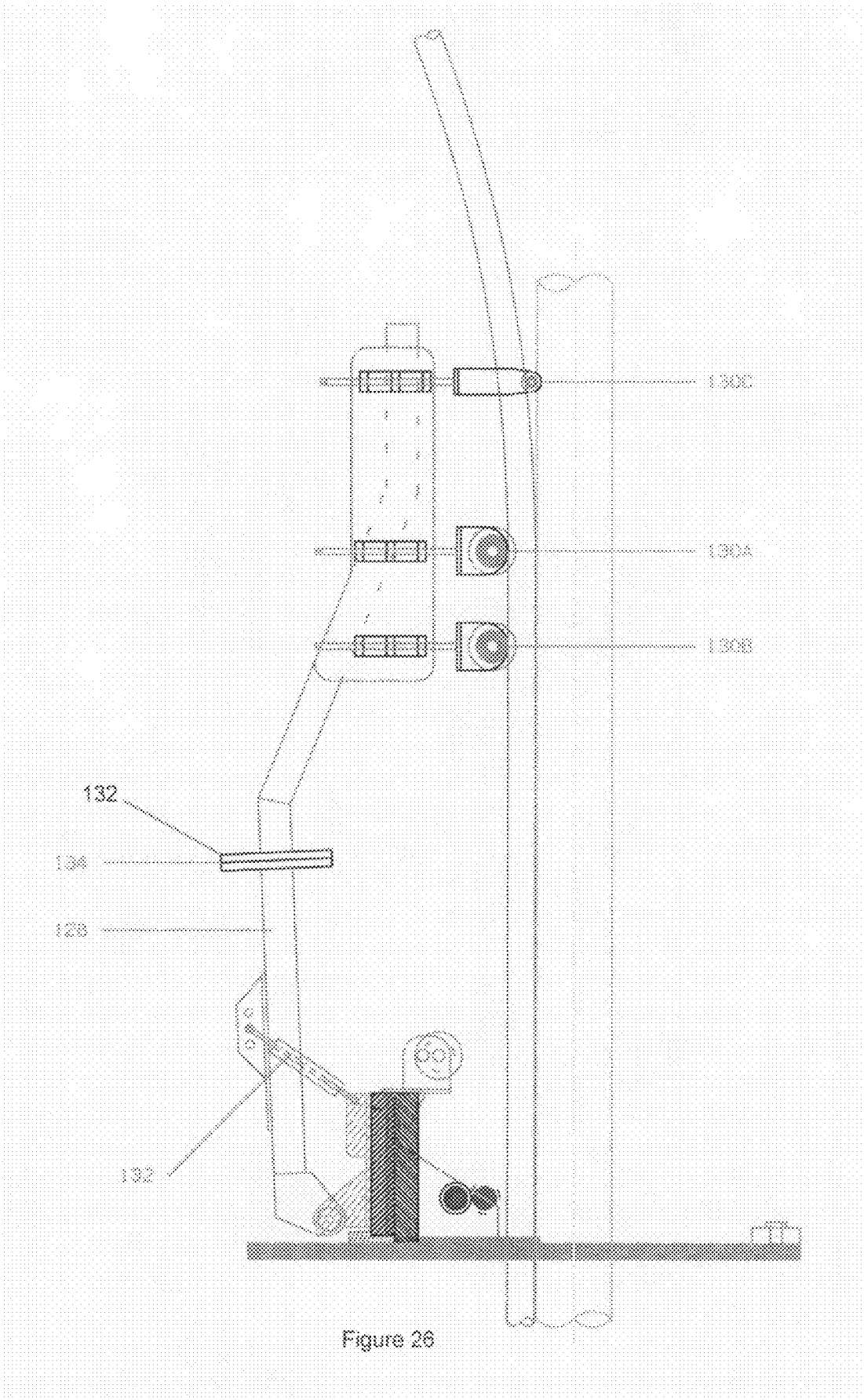
FIG. 26 shows the arm assembly of FIG. 25 in the clamping position.

FIG. 26 shows the arm assembly of FIG. 25 in the clamp position, i.e., the arm 128 is pivoted by the cylinder 132 so that the rollers 130A, 130B, and 130C are each closely adjacent the tubular, so that the flexible line is positioned to be clamped to the tubular. Each of these line guides may be selectively adjustable relative to the arm, and thus to the tubular, with the adjustment allowing movement of each roller's centerline toward or away from the arm. As explained subsequently, a biasing spring is provided for biasing each roller toward the tubular, and this biasing force may be overcome by the spring adjustment mechanism. Flange assembly 134 includes plate flanges 133. Any suitable simplistic mechanism for achieving arm rotation or arm swivel may be used, as explained subsequently. Cylinder 132 may be responsive to a circuit which includes a selectively adjustable shutoff, so that if fluid pressure rises above the selected amount, e.g., the arm assembly is moving from the run-in or neutral position to the clamp position and the flexible line spool does not spool out more line, the hydraulic cylinder will automatically shut off to prevent damage to the flexible line.

Figure 27:
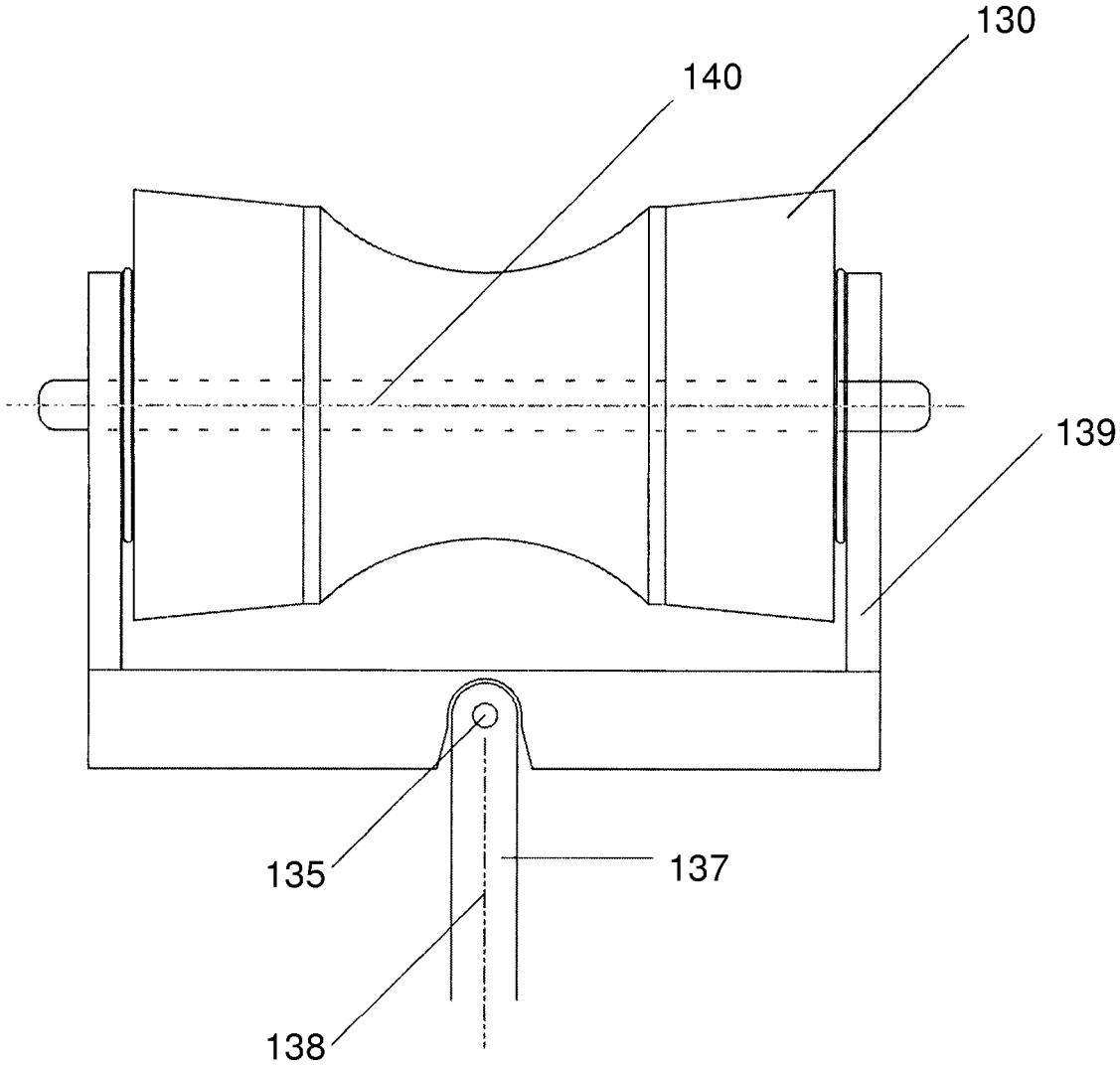
FIG. 27 illustrates a simplified line guide pivot mechanism.

FIG. 27 depicts another feature of the invention, namely that each roller 130 may be mounted on a conventional roller frame 139 with a swivel mechanism 135 allowing lateral movement of the frame 127 and thus the roller 130 relative to the support 136, which in this case may be moveable along axis 138 due to the previously mentioned adjustment mechanism. The axis 140 of the roller may swivel or turn in a lateral direction relative to the axis 138. This feature is important for line adjustment and guiding purposes, as explained subsequently.

Figure 30:
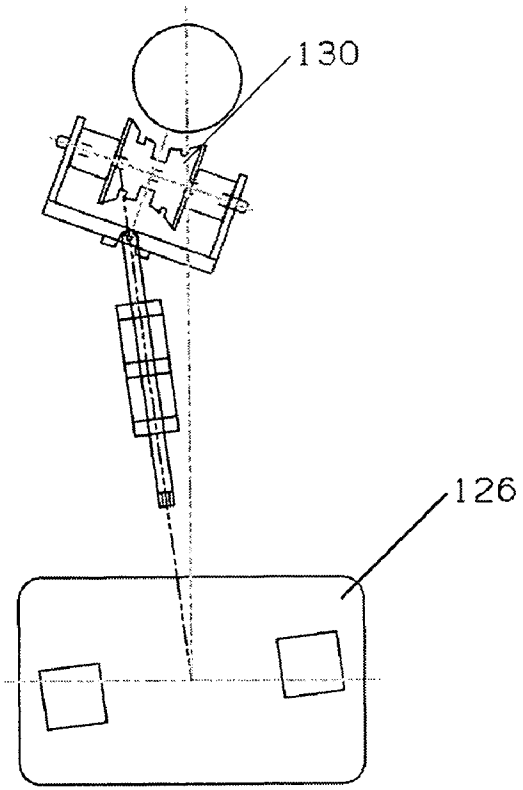
FIGS. 28, 29, and 30 illustrate adjustments of the line guide pivot mechanism and the arm swivel.
Figure 29:
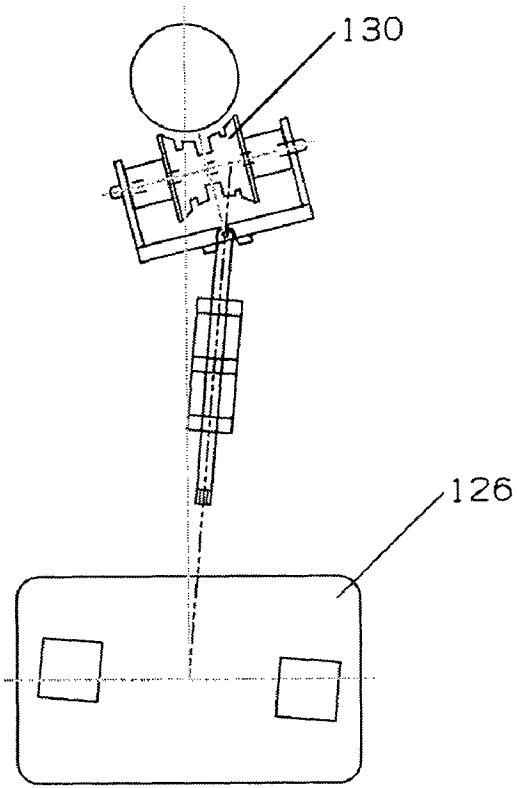
Figure 28:
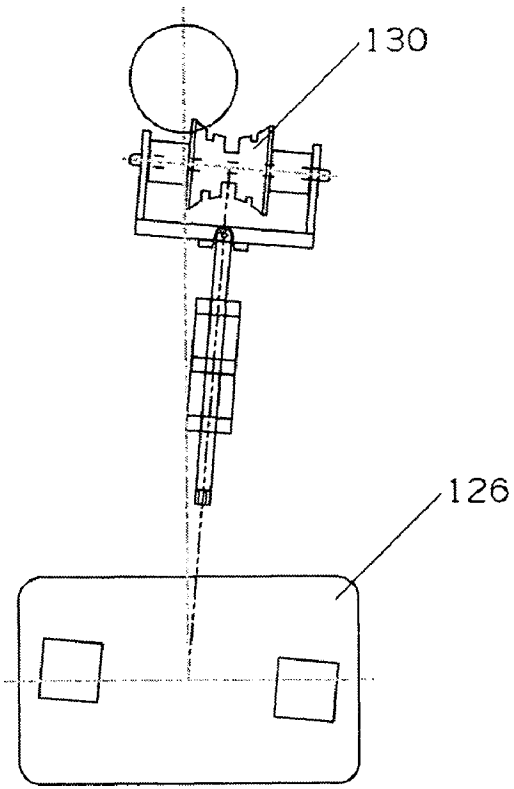

FIGS. 28, 29, and 30 each depict an assembly base in a stationary position, although the upper portion of the arm 128 is rotated slightly, e.g., 5° or 7.5°, and the control line guide is pivoted, so that a flexible line will desirably come off the guide and be properly positioned adjacent a side of the tubular. In FIG. 28, the top of the arm is rotated 5° in a clockwise direction, and the roller is not tilted, so that a flexible arm may be positioned substantially adjacent the 4:00 position on the tubular. In the FIG. 29 arrangement, the top of the arm is similarly rotated 5°, but the roller arm is now pivoted so that the flexible line exits the roller and engages the flexible tubular at substantially the 5:30 position. In this case, the roller is thus rotated approximately 19° in the counterclockwise direction. In the FIG. 30 position, the top of the arm is rotated 7.50 counterclockwise, and the roller is rotated in a clockwise direction approximately 28°, so that the flexible arm will engage the tubular at substantially the 7:00 position.

The selected arrangement of arm swivel and flexible line guide swiveling may thus be used to desirably position the flexible line against the tubular to be run in the well, even though the position of the line coming toward the centerline of the well varies significantly depending on the placement of the one or more flexible line spools.

Figure 31:
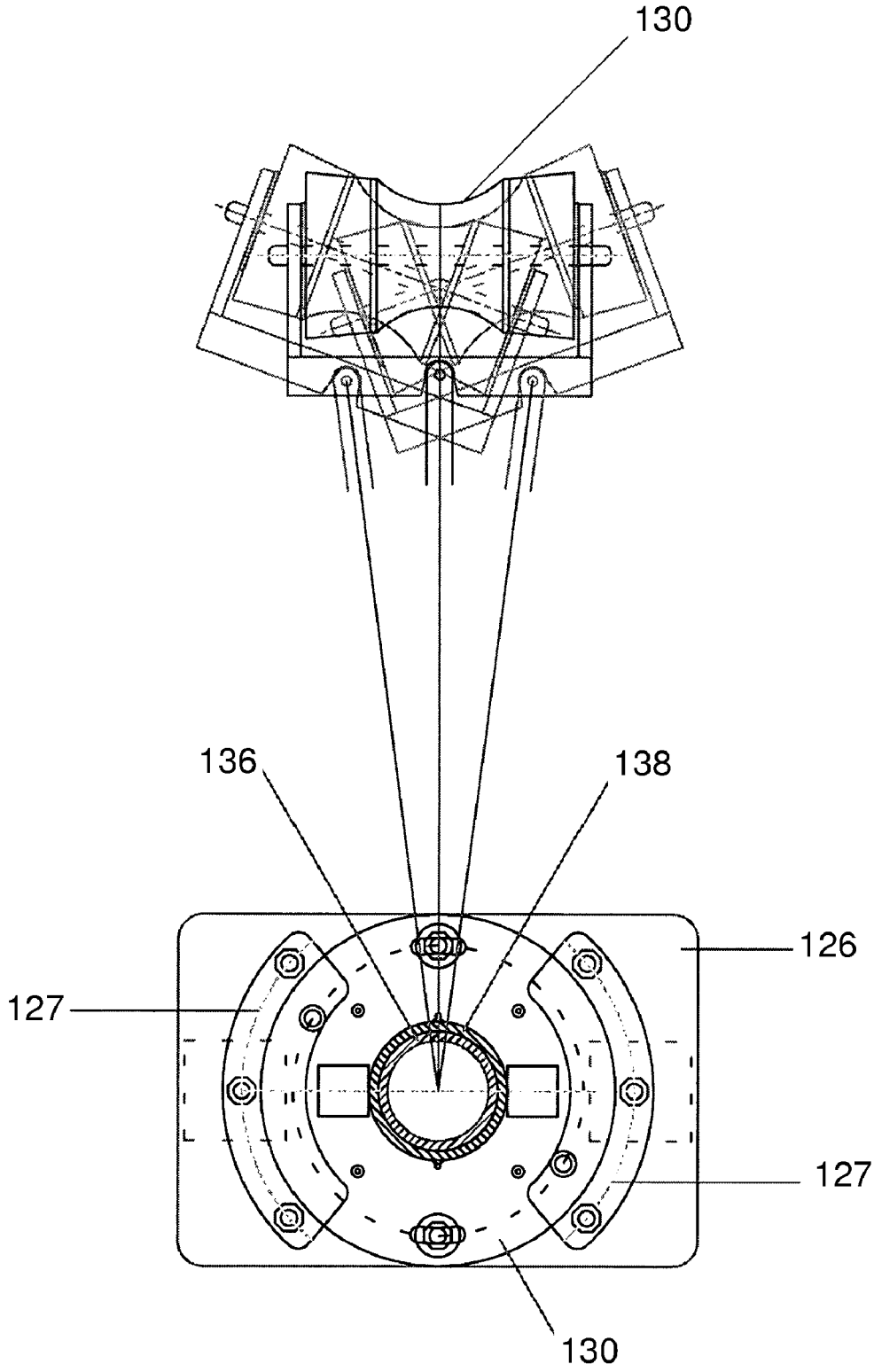
FIG. 31 illustrates an arm assembly with an arm swivel and a base plate.
Figure 32:
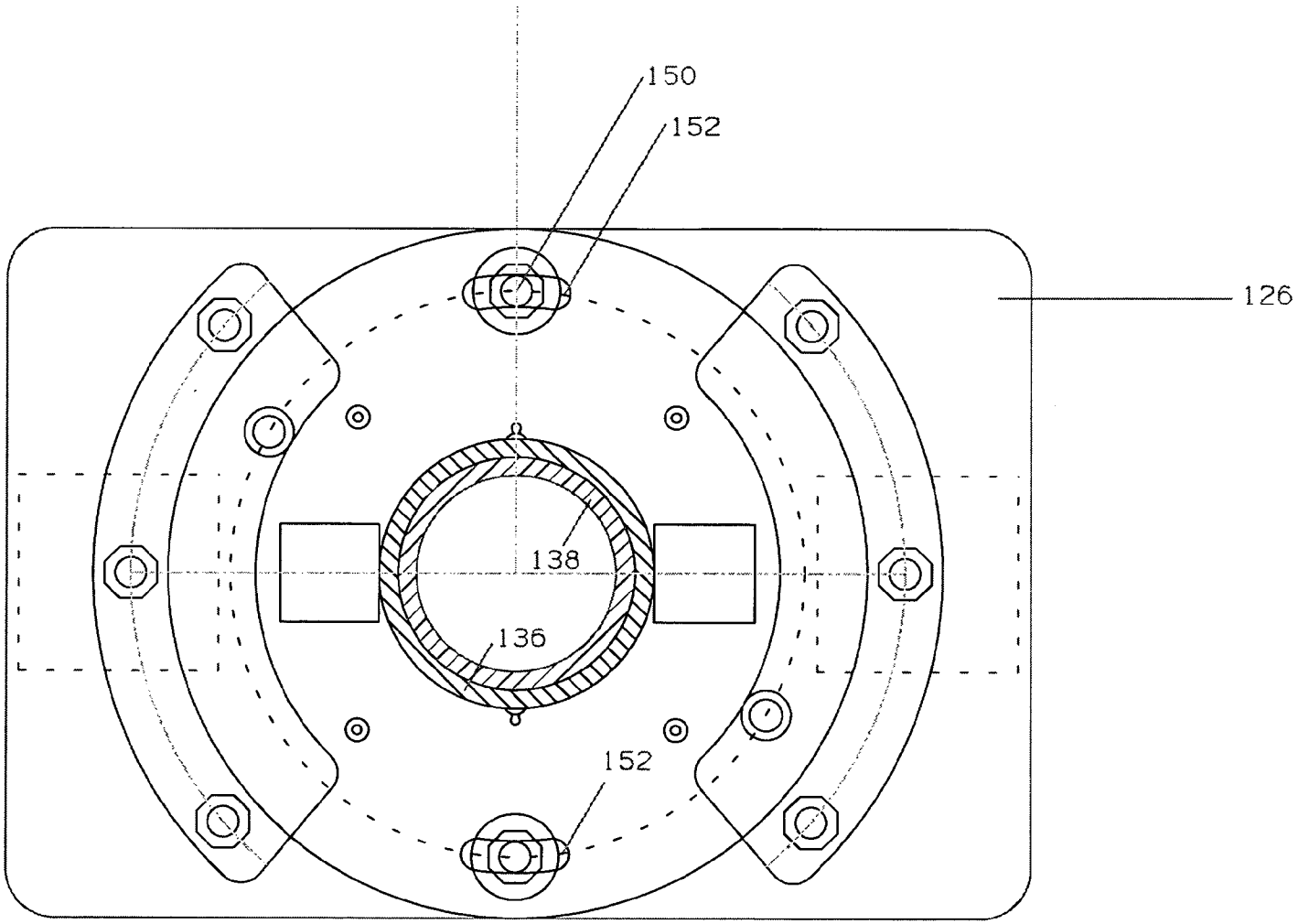
FIG. 32 is a more detailed view of the base plate shown in FIG. 31.

FIG. 31 illustrates in greater detail a base 126 for supporting the arm, and pivotal flanges 127 thereby allowing rotation of plate 180. The top portion 136 of the arm may thus rotate in either a clockwise or counterclockwise direction relative to the lower portion 138 of the arm, and thus relative to base 14. The guide roller 130 may also pivot in various directions, as discussed above, so that the guide desirably positions the flexible line adjacent the tubular. FIG. 31 thus shows limited rotational movement of the upper portion of the arm relative to the lower portion of the arm, and for the neutral and extreme pivot positions, various positions of the pivotable roller 130 relative to the arm are also shown. FIG. 32 depicts further details with respect to the base shown in FIG. 1. Bolts 150 may thus slide within a respective slot 152 to allow limited rotation of the upper portion 136 of the arm relative to the lower portion 138 of the arm. Those skilled in the art will appreciate that, while limited rotation of the arm relative to the base may be desirable while the arm is in use, the upper portion of the arm may rotate relative to the base outside of that limit, e.g., for shipment or handling purposes, or to position the arm in an out of the way position for other equipment at the well site. Also, it should be understood that the arm as disclosed herein may be shipped to the well in two pieces then assembled at the well site, if desired.

Figure 34:
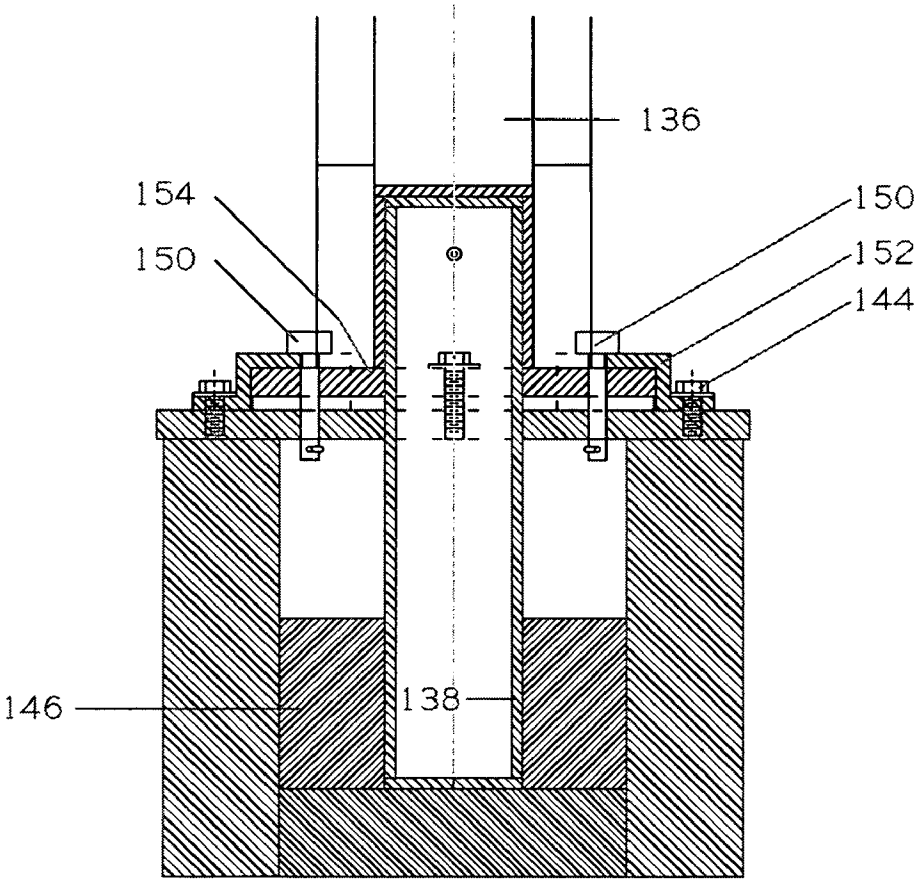
FIG. 34 is a front view of a suitable arm swivel.
Figure 33:
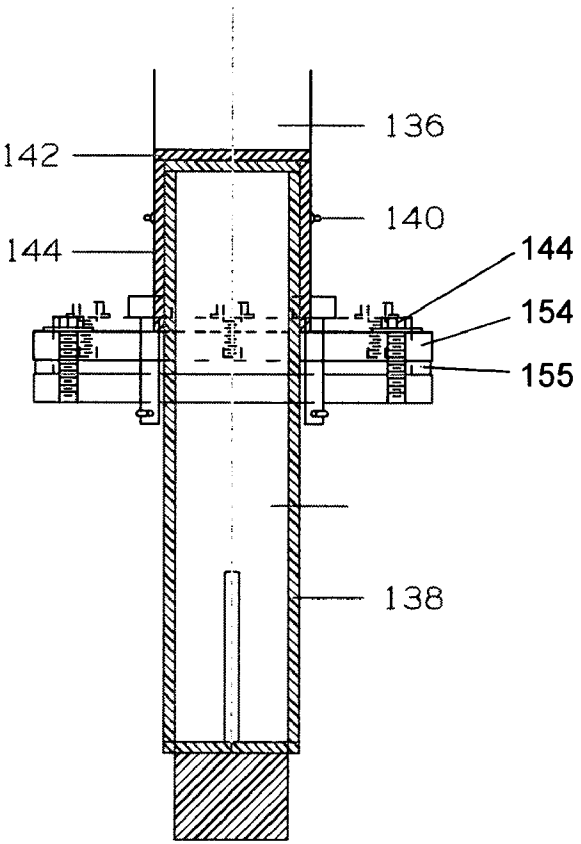
FIG. 33 is a side view of a suitable arm swivel.

FIG. 33 is a side view illustrating alternative components for the arm swivel. In this case, the arm includes an upper arm component 136 and a lower arm component 138 secured to the base 126. The upper component 136 may thus rotate relative to the lower arm component and the base. The upper arm component thus includes a top plate 142 and a lower sleeve 144 each secured to the upper arm component 136. The lower arm component 138 includes a base support 146. FIG. 33 also illustrates a polymer wear pad 155 to act as a load bearing pad for facilitating rotation. FIG. 34 is a front view of the assembly, and illustrates bolts 150 passing through a bracket 152 to the lower component 138. A flange 154 secured to the upper component 136 is positioned under the brackets, with bolts 150 holding the assembly in place. Bolts 150 each pass through an arcuate slot 152, as shown in FIG. 32. The bolts 150 may be loosened and the upper arm portion rotated relative to the base and the lower arm portion, as discussed above, for adjustment of flexible line positioning. The bolts 150 may be removed, allowing the upper arm component 136 to rotate in either a clockwise or counterclockwise direction relative to the lower arm component 138. Once rotated, the components may be pinned or otherwise secured, so that the arm assembly does not interfere with other rig equipment. A plurality of grease fittings 140 may be provided for facilitating this rotation.

Figure 36:
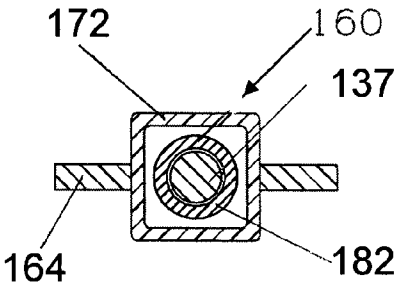
FIG. 36 is a top view of the assembly shown in FIG. 35.
Figure 35:
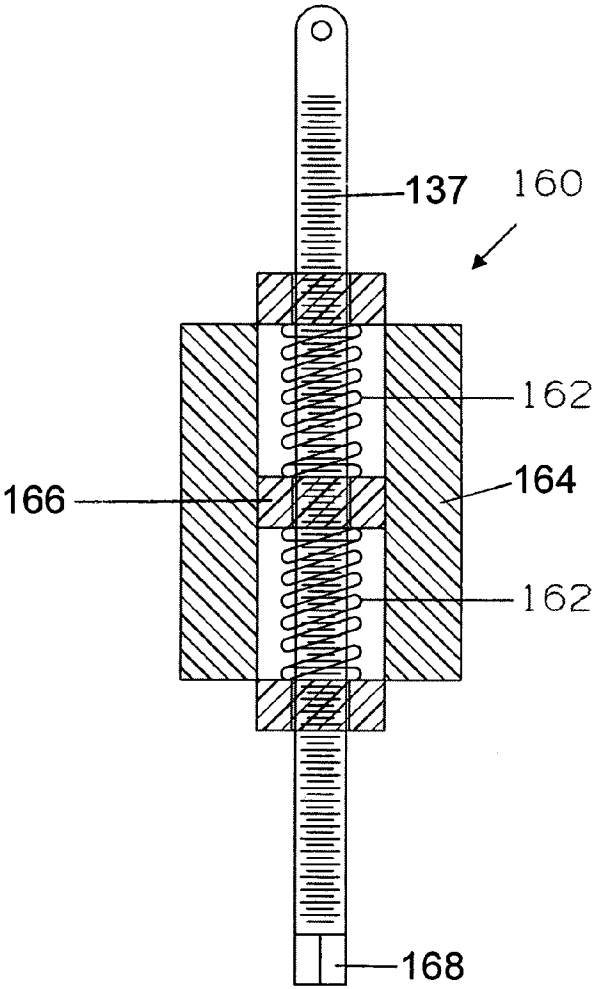
FIG. 35 is a more detailed view of a roller adjustment mechanism.

FIG. 35 depicts in greater detail a suitable adjustment mechanism 160, including a threaded rod 137 which may have a roller bracket and a roller at one end thereof. The adjustment mechanism includes a support bracket 164 on opposing sides of the threaded rod 137, with a nut member 166 non-rotatable with respect to but slidable within square tube 172, which is fixed to the bracket 164. Nut member 166 is threaded for engagement with the rod 137. End 168 may be rotated by a conventional means, such as a power wrench or a hand wrench, to desirably position the end of the threaded rod 137 relative to the arm assembly. FIG. 36 is a top view of the assembly shown in FIG. 35, and shows the bracket ears 164 and square tubing frame 172 which are secured to the upper end of the arm assembly, with the threaded rod 137 surrounded by spring 162.

Various conventional mechanisms may used for rotating the upper arm relative to the lower arm. For example, a manually operated arm may extend radially from the upper arm, thereby allowing an operator to manually rotate the upper arm relative to the lower arm. In other embodiments, a large wrench may used to grip the upper arm and simply rotate the upper arm relative to the lower arm until the desired rotational position is achieved, then the arm is bolted in that desired position.

While rollers are disclosed herein as a suitable type of line guide for engaging and guiding a flexible line, other types of line guides may be used, including hooks or rings which need not rotate relative to the arm, but still provide a flexible line guiding function. Also, the arm swivel as disclosed herein may be provided between the base and the upper portion of the arm, but alternatively a suitable swivel mechanism may be provided between the base and the arm itself.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An arm assembly for guiding one or more flexible lines at a well site for connection to or disconnection from a tubular member run into or out of a well, comprising:

a base positioned on a rig floor about the well;

a moveable arm extending upward from the base;

one or more line guides each supported on the arm for engaging the one or more flexible lines;

a line guide pivot mechanism for pivoting each line guide relative to the arm in a lateral direction; and an arm swivel for selectively rotating an upper portion of the arm relative to the base, such that the line guide pivot mechanism and the arm swivel may each be positioned for guiding a flexible line for connection with the tubular member.

2. An arm assembly as defined in claim 1, wherein the one or more line guides includes a plurality of the line guides, with at least one of the line guides engaging one circumferential side of the flexible line and another of the line guides engaging a circumferentially opposing side of the flexible line, such that the plurality of line guides effectively limit movement of the flexible line in a direction substantially along an axis of the flexible line.

3. An arm assembly as defined in claim 1, further comprising:

an adjustment mechanism for adjusting the position of each line guide with respect to the arm.

4. An arm assembly as defined in claim 1, further comprising:

a biasing member for biasing each line guide for engagement with the flexible line while allowing movement of the line guide toward the arm.

5. An arm assembly as defined in claim 4, wherein the biasing member is a spring acting between the arm and a line guide.

6. An arm assembly as defined in claim 1, further comprising:

a fluid powered device for moving the arm relative to the base.

7. An arm assembly as defined in claim 1, wherein the arm is telescopic.

8. An arm assembly as defined in claim 1, wherein at least one line guide is provided below the arm swivel, and a plurality of line guides are provided above the arm swivel.

9. An arm assembly as defined in claim 1, wherein each of the one or more line guides includes a plurality of slots, each slot sized for receiving a respective flexible line.

10. An arm assembly as defined in claim 1, wherein each of the one or more line guides includes a roller for engaging a flexible line, the roller being rotatable relative to the arm.

11. An arm assembly for guiding one or more flexible lines at a well site for connection to or disconnection from a tubular member run into or out of a well, comprising:

a base positioned on a rig floor about the well;

a moveable arm extending upward from the base;

a plurality of line guides each supported on the arm for engaging the one or more flexible lines, at least one of the line guides engaging one circumferential side of the flexible line and another of the line guides engaging a circumferentially opposing side of the flexible line, such that the plurality of line guides effectively limit movement of the flexible line in a direction substantially along an axis of the flexible line; and an arm swivel for selectively rotating an upper portion of the arm relative to the base, such that the arm swivel may be positioned for guiding a flexible line for connection with the tubular member.

12. An arm assembly as defined in claim 11, further comprising:

a line guide pivot mechanism for pivoting each line guide relative to the arm in a lateral direction.

13. An arm assembly as defined in claim 11, further comprising:

an adjustment mechanism for adjusting the position of each line guide with respect to the arm; and a biasing member for biasing each line guide for engagement with the flexible line while allowing movement of the line guide toward the arm.

14. An arm assembly as defined in claim 11, wherein at least one line guide is provided below the arm swivel, and a plurality of line guides are provided above the arm swivel.

15. An arm assembly as defined in claim 11, further comprising:

a fluid powered device for moving the arm relative to the base; and the arm is telescopic.

16. An arm assembly for guiding one or more flexible lines at a well site for connection to or disconnection from a tubular member run into or out of a well, comprising:

a base positioned on a rig floor about the well;

a moveable arm extending upward from the base, the arm being telescopic;

a plurality of line guides each supported on the arm for engaging the one or more flexible lines;

a line guide pivot mechanism for pivoting each line guide relative to the arm in a lateral direction; and an arm swivel for selectively rotating an upper portion of the arm relative to the base, such that the line guide pivot mechanism and the arm swivel may each be positioned for guiding a flexible line for connection with the tubular member.

17. An arm assembly as defined in claim 16, wherein at least one of the line guides engaging one circumferential side of the flexible line and another of the line guides engaging a circumferentially opposing side of the flexible line, such that the plurality of line guides effectively limit movement of the flexible line in a direction substantially along an axis of the flexible line.

18. An arm assembly as defined in claim 16, further comprising:

an adjustment mechanism for adjusting the position of each line guide with respect to the arm; and a biasing member for biasing each line guide for engagement with the flexible line while allowing movement of the line guide toward the arm.

19. An arm assembly as defined in claim 16, further comprising:

a fluid powered device for moving the arm relative to the base.

20. An arm assembly as defined in claim 16, wherein at least one line guide is provided below the arm swivel, and a plurality of line guides are provided above the arm swivel.

* * * * *